US005428186A

United States Patent [19]

Kaneko et al.

[11] Patent Number: 5,428,186

[45] Date of Patent: Jun. 27, 1995

[54] KEYBOARD INSTRUMENT SELECTIVELY ENTERING INTO ACOUSTIC SOUND MODE AND SILENT MODE THROUGH ANGULAR MOTION OF KEY BED STRUCTURE

[75] Inventors: Yasutoshi Kaneko; Kiyoshi Kawamura; Shinya Koseki, all of Shizuoka, Japan

[73] Assignee: Yamaha Corporation, Japan

[21] Appl. No.: 198,250

[22] Filed: Feb. 17, 1994

[30] Foreign Application Priority Data

Jan. 27, 1994 [JP] Japan ..... 6-023603

[51] Int. Cl.[6] ..... G10C 3/12; G10C 5/00; G10H 1/34

[52] U.S. Cl. ..... 84/719; 84/2; 84/3; 84/171; 84/423 R

[58] Field of Search ..... 84/719, 720, 744, 745, 84/2, 3, 13, 16–23, 115, 170–172, 246, 423 R, 433, DIG. 7

[56] References Cited

U.S. PATENT DOCUMENTS

| | | | |
|---|---|---|---|
| 533,661 | 2/1894 | McChesney et al. . | |
| 537,533 | 10/1894 | McChesney et al. . | |
| 2,250,065 | 7/1941 | Koel | 84/171 X |
| 4,633,753 | 1/1987 | Takahashi | 84/220 |
| 4,704,931 | 11/1987 | Nagai | 84/2 X |
| 4,744,281 | 3/1987 | Isozaki | 84/171 X |
| 4,970,929 | 11/1990 | Ishida | 84/120 |
| 5,001,339 | 3/1991 | Starkley et al. | 250/229 |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 97885 | 10/1897 | Germany . |
| 44782 | 9/1898 | Germany . |
| 3707591C1 | 5/1988 | Germany . |
| T091U0077 | 10/1992 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |

*Primary Examiner*—Stanley J. Witkowski
*Attorney, Agent, or Firm*—Graham & James

[57] ABSTRACT

An acoustic piano is equipped with an electronic sound generating system, and a key bed structure is angularly movable between an acoustic sound mode and an electronic sound mode for changing gaps between hammer heads and sets of strings, thereby allowing a player to perform a music with acoustic sounds or synthesized sounds.

9 Claims, 18 Drawing Sheets

KEYBOARD INSTRUMENT SELECTIVELY ENTERING INTO ACOUSTIC SOUND MODE AND SILENT MODE THROUGH ANGULAR MOTION OF KEY BED STRUCTURE

FIELD OF THE INVENTION

This invention relates to a keyboard instrument and, more particularly, to a keyboard instrument with angularly movable key bed structure for selectively entering into an acoustic sound mode and a silent mode.

DESCRIPTION OF THE RELATED ART

A typical example of a grand piano equipped with a muting mechanism is disclosed in Japanese Utility Model Publication of Unexamined Application (Kokai) No. 51-67732, and the muting mechanism lessens a hammer impact by using an elastic member. Namely, when a player depresses a key, the associated hammer is driven for rotation toward a set of strings, and concurrently strikes the elastic member and the strings. Then, the elastic member takes up part of the kinetic energy of the hammer so that the sound is lessened. In other words, the elastic member aims at reduction of impact against the strings. Although the muting mechanism gives rise to decrease of loudness of acoustic sounds, the player can not regulate the loudness to an arbitrary level.

Another related prior art is disclosed in U.S. Pat. No. 2,250,065, and the grand piano disclosed therein allows a player to practice fingerings on the keyboard. Namely, if the player previously lifts the hammer assemblies for producing gaps between the jacks and the hammer rollers, keys merely pushes up the jacks, and the jacks do not escape from the hammer assemblies. As a result, the hammer assemblies do not strike the strings, and, accordingly, the strings never vibrate for producing acoustic sounds. Thus, the grand piano disclosed in the United States Patent allows the player to practice the fingering without acoustic sounds. However, the player feels the escape of the jack unique to the piano, and hates the light key-touch.

SUMMARY OF THE INVENTION

It is therefore an important object of the present invention to provide a keyboard which allows a player to perform a music at an arbitrary volume without loss of a unique key-touch.

To accomplish the object, the present invention proposes to change a gap between hammer heads and strings through an angular motion of an action bracket means.

In accordance with the present invention, there is provided a keyboard instrument selectively entering into an acoustic sound mode for producing acoustic sounds and an electronic sound mode for producing synthesized sounds, comprising: a) an acoustic piano having a-1) a keyboard implemented by a plurality of swingable keys depressed by a player in both acoustic sound and electronic sound modes, notes of a scale being assigned to the plurality of swingable keys, a-2) a plurality of key action mechanisms respectively linked with the plurality of swingable keys, and selectively actuated by depressed keys of the keyboard in both acoustic sound and electronic sound modes, a-3) a plurality of hammer assemblies respectively associated with the plurality of key action mechanisms, and selectively driven for rotation by actuated key action mechanisms linked with the depressed keys in both acoustic sound and electronic sound modes, the actuated key action mechanisms and the associated hammer assemblies producing a piano-touch in both acoustic sound and electronic sound modes, a-4) a plurality of string means respectively associated with the plurality of hammer assemblies, and selectively struck by hammer assemblies driven by the actuated key action mechanisms in the acoustic sound mode for producing acoustic sounds, and a-5) an action bracket means supporting the plurality of key action mechanisms and the plurality of hammer mechanisms, and movable without change of a relative location between the plurality of key action mechanisms and the plurality of hammer mechanisms; b) an electronic sound generating system enabled in the electronic sound mode for producing synthesized sounds having notes identified by the depressed keys; and c) a mode controlling system operative to move the action bracket means for changing between a closed position and a spaced position, a gap between the plurality of hammer assemblies and the plurality of string means allowing the plurality of hammer assemblies to strike the plurality of string means in the closed position, the gap being increased in the spaced position for preventing the plurality of string means from strikes of the hammer assemblies.

The mode controlling means may have a key bed structure supporting the action bracket means and implemented by a stationary board member and a movable board member angularly movable with respect to the stationary board member.

The mode controlling means may have a gap controlling mechanism for swinging the action bracket means such that the gap between the plurality of hammer assemblies and the plurality of string means is varied depending upon the mode of operation.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS

First Embodiment

Figure 1:
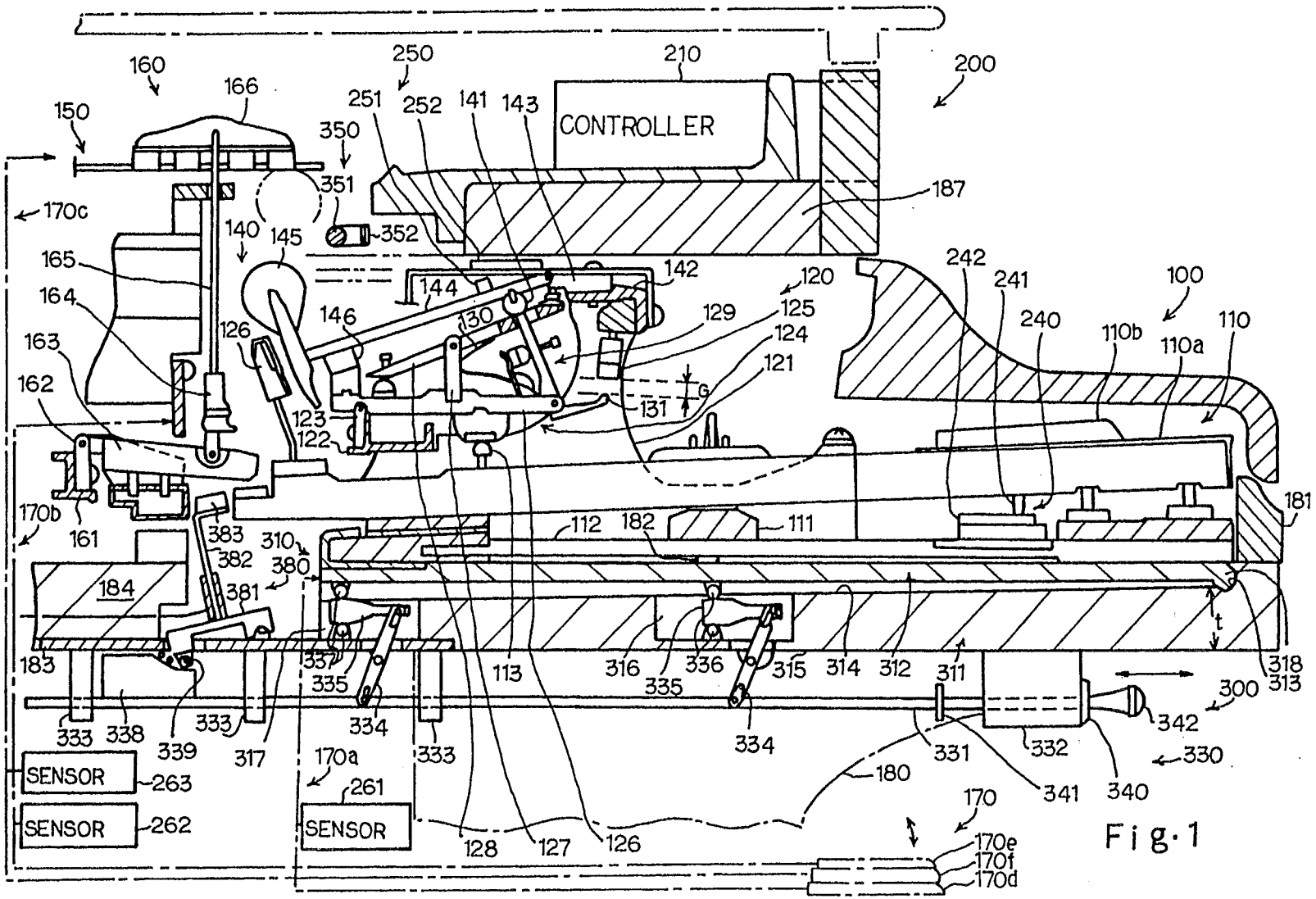
FIG. 1 is a cross sectional view showing essential parts of a keyboard instrument in an acoustic sound mode according to the present invention.
Figure 2:
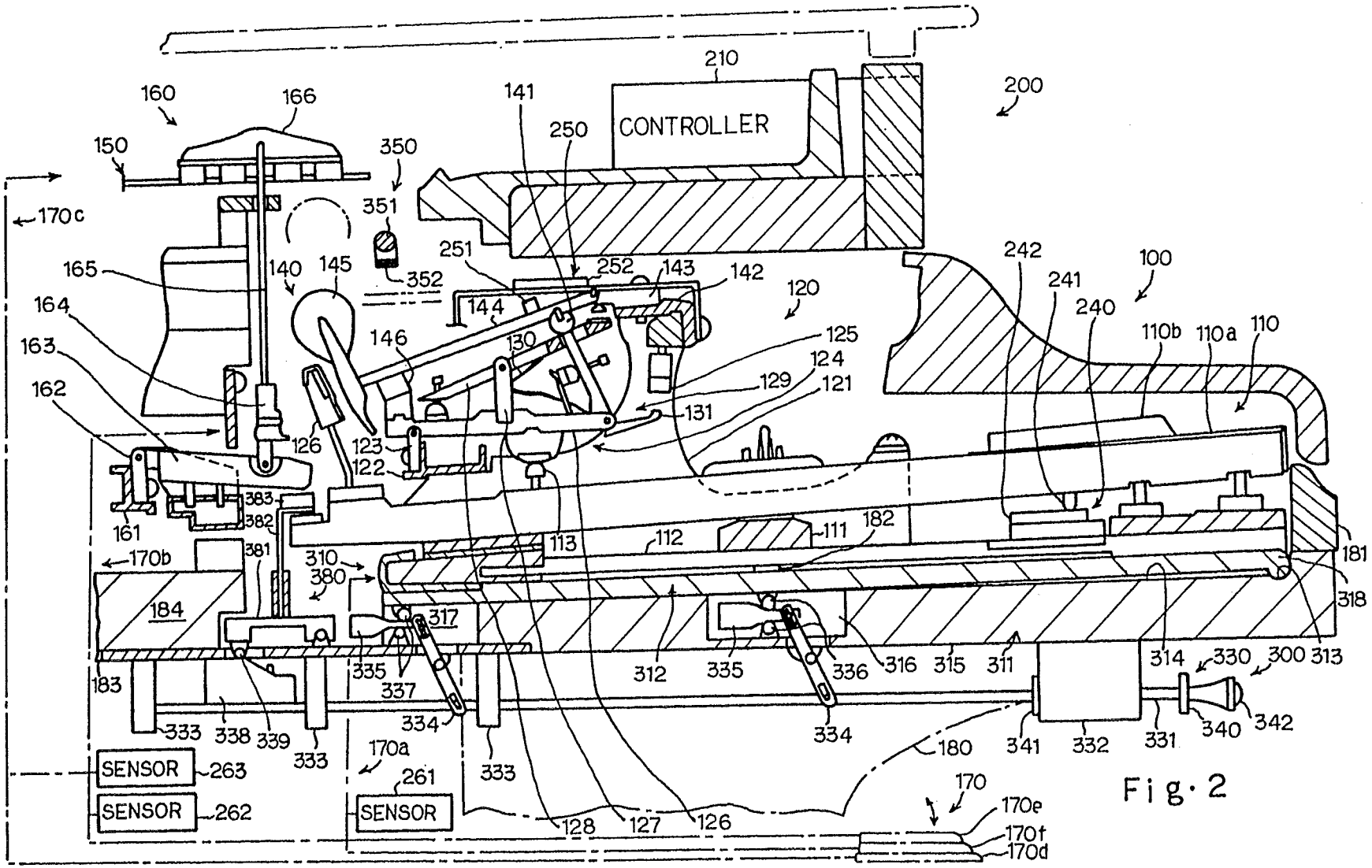
FIG. 2 is a cross sectional view showing the essential parts of the keyboard instrument in a silent mode.

Referring first to FIGS. 1 and 2 of the drawings, a keyboard instrument embodying the present invention largely comprises a grand piano 100, an electronic sound generating system 200 and a mode controlling system 300, and selectively enters into at least an acoustic sound mode (see FIG. 1) for producing acoustic sounds through vibrations of strings and a silent mode (see FIG. 2). While the keyboard instrument is in the silent mode, the mode controlling system 300 allows a player to practice a fingering without sound or to perform a music through generation of electronically synthesized sounds. The generation of electronically synthesized sounds in the silent mode is referred to as an electronic sound sub-mode, and the fingering without synthesized sounds is called as a true silent sub-mode. The synthesized sounds may have the same timbre as the acoustic sounds. However, the electronic sound generating system 200 may give a different timbre to the electronic sounds depending upon player's selection. The keyboard instrument may enters into a recording mode for producing and storing data codes in a floppy disk, and the data codes may be sequentially read out from the floppy disk for reproducing a music in a playback mode.

In the following description, term "clockwise direction" is determined on the figure illustrating the rotating component member, and words "front" and "rear" means relative positions with respect to a player sitting in front of the keyboard instrument for playing it.

The grand piano 100 largely comprises a keyboard 110, a plurality of key action mechanisms 120, a plurality of hammer assemblies 140, a plurality sets of strings 150, a plurality of damper mechanisms 160 and a pedal mechanism 170.

The keyboard 1 is implemented by a plurality of black and white keys 110*a* and 110*b*, typically eighty-eight keys, and each key 110*a* or 110*b* is rockable or swingable with respect to a balance rail 111 on a key frame 112. The key frame 112 is fixed to a key bed structure 310, and the key bed structure 310 forms a part of the mode controlling system 300 as will be described hereinlater.

The notes of a scale are respectively assigned to the black and white keys 110*a* and 110*b* as well as to the sets of strings 150, and each of the black and white keys 110*a* and 110*b* is swingable between a rest position and an end position. The black and white keys 110*a* and 110*b* are respectively linked with the key action mechanisms 2 and with the damper mechanisms 160, and actuate the associated key action mechanisms 120 and the associated damper mechanisms 160.

The key action mechanisms 120 are similar in structure to one another, and each key action mechanism 120 largely is supported by an action bracket 121. The action bracket 121 is fixed to a bracket block (not shown) which is mounted on the key bed structure 310.

The key action mechanism comprises a whippen rail 122 expending over the rear end portions of the keys 110*a* and 110*b* and bolted to the action bracket 121, a whippen flange 123 fixed to the whippen rail 122, a whippen assembly 124 turnable around the whippen flange 123 and a regulating button 125 supported by the action bracket 121 and associated with the whippen assembly 124. A back check 126 is further incorporated in the key action mechanism 2*a*, and brakes the hammer assemblies 140 on the way to its home position.

The whippen assembly 124 comprises a whippen 126 swingably supported by the whippen flange 123, a repetition lever flange 127 upright from the whippen 126, a repetition lever 128 rockably supported by the repetition lever flange 127, a jack 129 swingably supported by the leading end of the whippen 126 and a repetition spring 130 urging the repetition lever 128 in the counter clockwise direction.

The whippen 126 has a whippen heel held in contact with a capstan screw 113 implanted in the rear end portion of the associated key, and the associated key pushes up the whippen 126 through the capstan screw 113 and the whippen heel.

The jack 129 is held in contact with a hammer roller 141 of the associated hammer assembly 140 while the key is in the rest position. The jack 129 has a toe 131 opposed to the regulating button 125, and the gap G therebetween is regulable by rotating the regulating button 125.

Each hammer assembly 140 comprises a shank flange rail 142 bolted to the action bracket 121 and shared between the other hammer assemblies 140, a shank flange 143 bolted to the shank flange rail 142, a hammer shank 144 turnable around the shank flange 143, the hammer roller 141 rotatably supported by the hammer shank 144, a hammer head 145 fixed to the leading end of the hammer shank 144, and a hammer shank stop felt 146 provided on the whippen 126. While the key is staying in the rest position, the hammer roller 141 is engaged with the head of the jack 129, and the hammer shank 144 rests on the hammer shank stop felt 146.

The sets of strings 150 are horizontally stretched between tuning pins (not shown) and frame pins (not shown) over the hammer assemblies 140, and On the other hand, if the key 110*a* or 110*b* is depressed, the capstan screw 113 pushes up the whippen heel, and the whippen 126 and the jack 129 rotate in the counter clockwise direction around the whippen flange 123. However, the rotation around the whippen flange 123 does not change the relative position between the whippen 126 and the jack 129. The jack 129 pushes up the hammer roller 141, and, accordingly, the hammer assembly 140, and the decreases the gap G between the toe 131 and the regulating button 125. When the toe 131 comes into contact with the regulating button 125, the jack 129 per se turns around the whippen 126 in the clockwise direction against the repetition spring 130, and, finally, escapes from the hammer assembly 140. This results in that the jack 129 kicks the hammer roller 141, and the hammer head 145 rushes toward the associated set of strings 150 at high speed. If the keyboard instrument is in the acoustic sound mode, the hammer head 145 strikes the set of strings 150, and rebounds on the strings 150 as similar to an ordinary grand piano. The jacks 129 escape from the associated hammer rollers 141 when the hammer heads 145 decrease the distance from the strings 150 to 2 to 3 millimeters as similar to an acoustic grand piano.

Each of the damper mechanisms 160 comprises a damper lever rail 161 shared between the damper assemblies 5, a damper lever flange 162 fixed to the damper lever rail 161, a damper lever 163 turnably supported by the damper lever flange 162, a damper block 164 pivotally connected with the damper lever 163, a damper wire 165 projecting from the damper block 164, and a damper head 166 connected with the leading end of the damper wire 165.

While the key 110*a* or 110*b* is staying in the rest position, the damper lever 163 is pushed down due to the self-weight, and the damper head 166 is held in contact with the associated set of strings 150 so as to prevent the strings 150 from vibrations. The leading end portion of the damper lever 163 is spaced apart from the rear end portion of the key 110*a* or 110*b*.

When the key 110*a* or 110*b* is depressed, the key 110*a* or 110*b* is moving from the rest position to the end position, and the rear end of the key 110*a* or 110*b* comes into contact with the damper lever 163. The key 110*a* or 110*b* pushes up the damper lever 163, and the damper lever 163 turns around the damper lever flange 162 in the counter clockwise direction. The damper wire 165 and the damper head 166 are lifted by the damper lever 163, and space the damper head 506 from the set of strings 150. As a result, the strings 150 are allowed to vibrate upon a strike with the hammer head 145.

The pedal mechanism 170 comprises a soft pedal sub-mechanism 170*a* for lessening the volume by causing fewer than the normal number of strings 150 to be struck, a damper pedal sub-mechanism 170b for prolonging the sounds by holding off the damper heads 166, and a muffler pedal sub-mechanism 170*c* for enabling selected notes to be sustained. A soft pedal 170*d*, a damper pedal 170*e* and a muffler pedal 170*f* are respectively connected with the sub-mechanisms 170*a* to 170*c*, and a player selectively steps on these pedals 170*d* to 170*f* during a music. However, these pedal sub-mechanism 170*a* to 170*c* are similar to those of the ordinary grand piano, and no further description is incorporated hereinbelow.

The electronic sound generating system 200 largely comprises a controller 210, a plurality of key sensors 240 each implemented by a shutter plate 241 and a photo-interrupter 242, a plurality of hammer sensors 250 also each implemented by a shutter plate 251 and a photo-interrupter 252, three pedal sensors 261, 262 and 263 for monitoring the three pedal sub-mechanisms 170a to 170c, a mode shift switch 270, a speaker system 271 and a headphone 272 connectable with a socket 273. The mode shift switch 270 may be linked with a shift lever 331 of a shift mechanism 330 forming a part of the mode controlling system 300, and the speaker system 271 may be accommodated in the piano case. The socket 273 may be provided on a key block (not shown).

The plurality of key sensors 240 are respectively associated with the plurality of keys 110*a* and 110*b*, and the shutter plate 241 and the photo-interrupter 242 are fixed to the bottom surface of the associated key 110*a* or 110*b* and to the key frame 112, respectively. The shutter plate 251 and the photo-interrupter 252 of each hammer sensor 250 are respectively fixed to the hammer shank 144 and a bracket member bolted to the action bracket 121, and monitor the associated hammer assemblies 140. The key sensors 240 and the hammer sensors 250 are enabled in the silent mode, and are not powered in the acoustic sound mode in view of power saving. In the silent mode, the key sensors 240 and the hammer sensors 250 report the motions of the associated keys 110*a* and 110*b* and the motions of the associated hammer assemblies 140, and the controller 210 determines the note, the strength, the timing, etc. for each synthesized sound to be produced as if the corresponding strings are actually struck.

The pedal sensors 261 to 263 are also powered in the silent mode, and monitor the three pedal sub-mechanisms 170*a* to 170*c* to see whether or not the player steps on any one of the three pedals. If the player steps on one of the pedals, the associated pedal sensor 261, 262 or 263 detect the motion of the pedal, and report the position to the controller 210.

Figure 3:
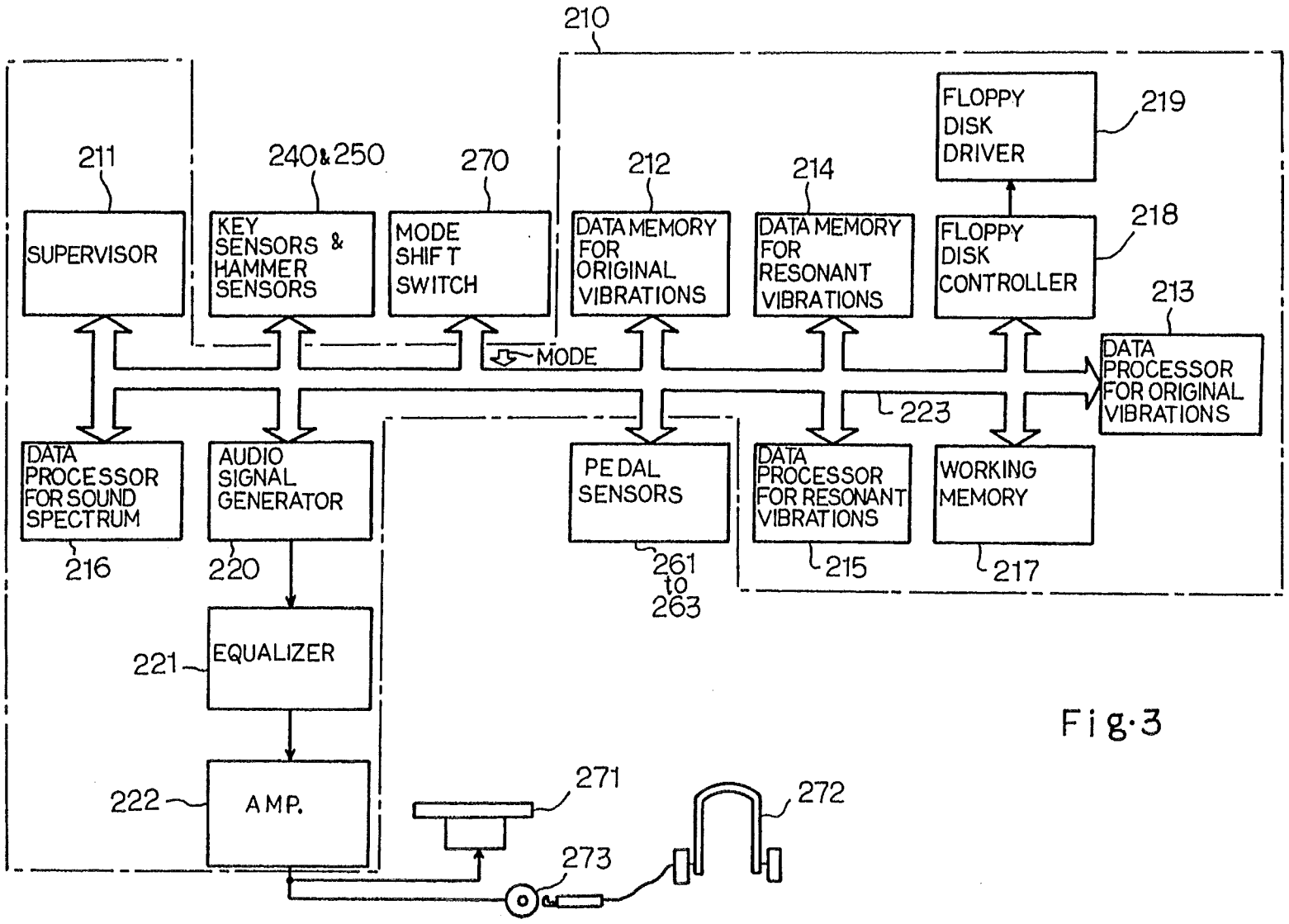
FIG. 3 is a block diagram showing an electronic sound generating system incorporated in the keyboard instrument.

As shown in FIG. 3, the controller 210 comprises a supervisor 211, a data memory 212 for original vibrations, a data processor 213 for original vibrations, a data memory 214 for resonant vibrations, a data processor 215 for resonant vibrations, a data processor 216 for sound spectrum, a working memory 217, a floppy disk controller 218, a floppy disk driver 219, an audio signal generator 220, an equalizer 221, an amplifier 222 and a bus system 223.

As will be described hereinlater in detail, a mode shift switch 270 produces a mode signal MODE indicative of one of the acoustic sound mode, the electronic sound sub-mode and the true silent sub-mode, and the mode signal MODE is assigned to one of the signal input ports of the controller 210. The other signal input ports are assigned the key sensors 240, the hammer sensors 250 and the pedal sensors 261 to 263.

The supervisor 211 sequentially scans the signal input ports assigned to the mode control signal MODE, the detecting signals from the key sensors 240, the hammer sensors 250 and the pedal sensors 261 to 263, and supervises the other components 212 to 220 for producing an audio signal.

An internal table is incorporated in the supervisor 211, and the internal table defines relation between the key numbers previously assigned to the keys 110*a* and 110*b*, key velocity and timings for producing the audio signal. The audio signal is supplied from the audio signal generator 220 through the equalizer 221 to the amplifier unit 221, and the audio signal is selectively distributed to the speaker system 271 and the headphone 272 depending upon the player's selection. Various internal registers are incorporated in the supervisor 211, and one of the internal registers is assigned to a mode flag indicative of the presently designated mode.

The data memory 212 for original vibrations stores a plurality sets of pcm (Pulse Code Modulation) data codes indicative of frequency specular of original vibrations on the strings 150, and each set of pcm data codes is corresponding to one of the keys 110*a* and 110*b*. A plurality groups of pcm data codes form a set of pcm data codes, and are corresponding to frequency specular at different intensities or hammer speeds. In general, if a hammer head 145 strongly strikes the associated strings 150, higher harmonics are emphasized.

The plurality sets of pcm data codes are produced with a sampler (not shown) through sampling of actual vibrations on the sets of strings 150 at appropriate sampling frequency. However, the set of pcm data codes may be produced by means of the data processor 216 through a real-time manner. Using a group of pcm data codes, original vibrations produced upon depressing a key 110*a* or 110*b* are restored, and the supervisor 211 controls the sequential access to a group of pcm data codes stored in the data memory 212.

The data processor 213 for original vibrations is provided in association with the data memory 212, and modifies a group of pcm data codes for an intermediate hammer speed. The modification by the data processor 213 is also controlled by the supervisor 211.

As described hereinbefore, the intensity of frequency spectrum is corresponding to the hammer speed. However, the intensities are variable with the type and model of the piano.

The data memory 214 for resonant vibrations stores a plurality sets of pcm data codes indicative of resonant vibrations, and the resonant vibrations take place under step on the damper pedal 170*e*. While a player steps on the damper pedal 170*e*, the damper heads 166 are held off, and some of the related strings are resonant with the strings directly struck by the associated hammer head 145. The resonant tones range −10 dB and −20 dB with respect to the tone originally produced through strike with the hammer head 145, and time delay of several millisecond to hundreds millisecond is introduced between the originally produced tone and the resonant tones.

If the player continuously steps on the damper pedal 170*e*, the resonant tones continues several seconds. However, the player can rapidly terminate the original and resonant tones by releasing the damper pedal 170*e*, and the audio signal generator 220 is responsive to the detecting signal of the pedal sensors 261 for the rapid termination.

The pcm data codes stored in the data memory 214 are indicative of frequency specular of the resonant vibrations, and are also produced by means of the sampler or the data processor 215 for resonant vibrations.

Each of the plurality sets of pcm data codes for the resonant tones is addressable with the detecting signal indicative of the depressed key 110*a* or 110*b*, and is constituted by six groups of pcm data codes at the maximum. Each group of pcm data codes is corresponding to one of the resonant strings 150, and the second harmonic to the sixth harmonic are taken into account for strings one octave higher than low-pitched sounds. However, if the depressed key is lower than the thirteenth key with respect to the lowest key, the string one octave lower than the depressed key should be taken into account.

A set of pcm data codes are sequentially read out from the data memory 214 depending upon the depressed key 110*a* or 110*b* under the control of the supervisor 211, and the data processor 215 for resonant vibrations modifies the pcm data codes for an intermediate intensity. The memory capacity of the data memory 214 may be large enough to store the pcm data codes at all of the detectable hammer speeds, and the data processor 215 may calculate each set of pcm data codes on the basis of parameters stored in the data memory 214.

The data processor 216 for sound spectrum can produce not only a group of pcm data codes indicative of frequency spectrum for original vibrations but also a set of pcm data codes indicative of frequency specular for resonant vibrations as described hereinbefore. The data processor 216 is further operative to cause the frequency specular to decay. In detail, when a player releases a key of an acoustic piano, original vibrations on a set of strings rapidly decays, because an associated damper head is brought into contact with the strings. In the electronic sound generating system 200, the data processor 216 simulates the decay of the vibrations, and sequentially decreases the values of the pcm data codes. The resonant tones continue for several seconds in so far as the player keeps the damper pedal 170*e* in the depressed state. However, if the player releases the damper pedal 170*e*, the resonant tones are rapidly decayed. The data processor 216 also simulates the decay, and sequentially decreases the values of the pcm data codes for the resonant vibrations.

The decay is not constant. If the player releases the damper pedal 170*e* through a half pedal, the tones decay at lower speed rather than the ordinary release. Moreover, some players use the half pedal in such a manner as to retard low-pitched tones rather than high-pitched tones, and such a pedal manipulation is called as an oblique contact. On the contrary, if the damper pedal 170*e* causes all the dampers to be simultaneously brought into contact with the strings 150, the damper manipulation is referred to as simultaneous contact. The data processor 216 further can simulate the gentle decay for the release through the half pedal as well as the oblique contact, and the values of the pcm data codes are decreased at either high, standard or low speed in the simultaneous contact and at different speed in the oblique contact. The data processor 216 may change the ratio between the fundamental tone and the harmonics thereof for the half pedal, and decay high-order harmonics faster than the fundamental tone. The frame of an acoustic piano usually vibrates, and the frame noise participates the piano tone. The data processor 216 may take these secondary noise into account and modify the frequency ratio.

The audio signal generator 220 comprises a digital filter, a digital-to-analog converter and a low-pass filter, and produces the analog audio signal from the pcm data codes supplied from the data memories 212 and 214 and/or the data processors 213, 215 and 216. The pcm data codes are subjected to a digital filtering, and are, then, converted into the analog audio signal. In the digital filtering, the vibration characteristics of the speaker system 271 and vibratory characteristics of the speaker box (not shown) are taken into account, and the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal, and the analog audio signal is filtered by the low-pass filter. The low-pass filter is of a Butterworth type for improving group delay. The analog audio signal thus filtered is supplied through the equalizer 221 to the amplifier unit 222, and the amplifier unit 222 amplifies the analog audio signal for driving the speaker system 271 or the headphone 272.

The floppy disk driver 219 reads out data codes formatted in accordance with the MIDI standards from a floppy disk under the control of the floppy disk controller 218, and the supervisor 211 allows the audio signal generator 220 to reproduce sounds from the data codes read out from the floppy disk. Therefore, a music can be reproduced in the timbre of another musical instrument such as, for example, a pipeorgan, a harpsichord or a wind musical instrument.

The supervisor 211 may format the detecting signals of the key and hammer sensors 240 and 250 and the detecting signals of the pedal sensors 261 to 263 in accordance with the MIDI standards, and the MIDI codes are stored in a floppy disk under the control of the floppy disk controller 218. If the keyboard instrument can record and reproduce a performance, the keyboard instrument has four modes of operation, i.e., the acoustic sound mode, the silent mode, the recording mode and the playback mode, and the silent mode also has two sub-modes.

Turning back to FIG. 1, the mode controlling system 300 comprises the key bed structure 310 associated with the keyboard 110, the shift mechanism 330 associated with the key bed structure 310, a stopper mechanism 350 associated with the hammer assemblies 140 and a spacer mechanism 380 associated with the damper mechanism 160. The mode controlling system 300 establishes the acoustic sound mode and the silent mode in the keyboard instrument embodying the present invention.

The key bed structure 310 comprises a stationary board member 311 supported by legs 180 and a movable board member 312 angularly movable with respect to the stationary board member 311, and the key frames 112 and the action brackets 121 are supported by the movable board member 312. A recess 313 is formed in the front end portion of the stationary board member 311, and the stationary board member 311 gradually decreases the thickness t thereof from the front end toward the rear end. For this reason, the top surface 314 of the stationary board member 311 is oblique at 1 to 2 degrees with respect to the bottom surface 315. Hollow spaces 316 and 317 are formed in an intermediate portion and the rear end portion of the stationary board member 311, and are open to the top surface 314 and the bottom surface 315. A key slip 181 is mounted on the top surface of the front end portion of the stationary board member 311, and the hollow space 316 is formed below a beding screw 182.

The front end portion of the movable board member 312 is rounded over the width thereof, and the round front end portion 318 is rotatably received in the recess 313. Therefore, the stationary board member 311 allows the movable board member 312 to angularly move, and restricts a movement in the fore-and-aft direction of the keyboard instrument. In this instance, the movable board member 312 is uniform in thickness, and the round front end portion 318 and the recess 313 form in combination a pivotal joint.

Figure 4A:
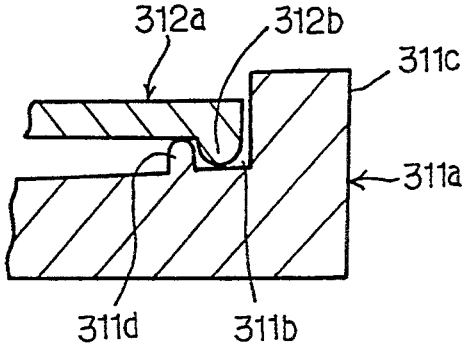
FIGS. 4A to 4C are cross sectional views showing alternative pivotal joints available for a key bed structure incorporated in the keyboard instrument.
Figure 4B:
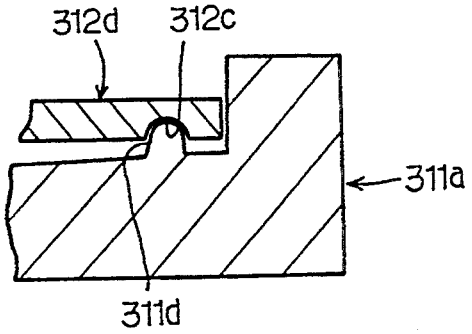
Figure 4C:
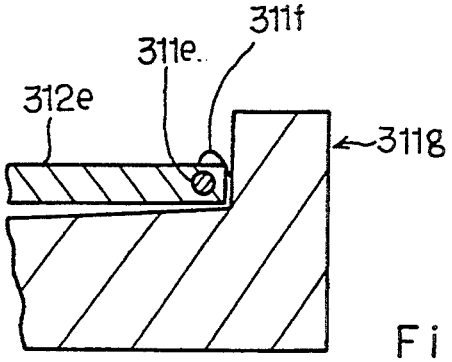

Various pivotal joints may be available for the stationary and movable board members 311 and 312 as shown in FIGS. 4A to 4C. In FIG. 4A, a stationary board member 311*a* form a groove 311*b* between the front end portion 311*c* and a projecting portion 311*d*, and the movable board member 312*a* has a round portion 312*b* projecting from the bottom surface thereof. The round portion 312*b* is received in the groove 311*b*, and the projecting portion 311*d* allows the movable board member 312*a* to angularly move, but does not allow to move in the fore-and-aft direction.

The pivotal joint shown in FIG. 4B is different in movable board member from the pivotal joint shown in FIG. 4A. A recess 312*c* is formed in the front end portion of the movable board member 312*d*, and the projection 311*d* has a round surface. The projection 311*d* is received in the recess 312*c*, and allows the movable board member to angularly move. However, the projection 311*d* restricts a motion of the movable board member 312*d* in the fore-and-aft direction.

The pivotal joint shown in FIG. 4C has a rod member 311*e* pivotally supported at both end thereof by bracket members 311*f* mounted on the top surface of a stationary board member 311*g*, and the rod member 311*e* is snugly received in a through hole formed in a movable board member 312*e*. The rod member 311*e* and the movable board member 312*e* is angularly moved with respect to the bracket members 311*f* and, accordingly, with the stationary board member 311*g*.

Turning back to FIG. 1 of the drawings, the shift mechanism 330 comprises the three shift lever 311 slidably supported by bracket members 332 and 333, arm members 334 pivotally connected with each shift lever 331, first cam members 335 pivotally connected with the arm members 334 for the key bed structure 310, a pair of roller units 336 engaged with the first cam member 335 in the hollow space 316, another pair of roller units 337 engaged with the first cam member 335 in the hollow space 317, a second cam member 338 attached to each shift lever 331 for the spacer mechanism 380 and a roller unit 339 engaged with each second cam member 338, a pair of stopper members 340 and 341 attached to each shift lever 331 for determining the stroke of the shift lever 331, connecting rods (not shown) for interconnecting the three shift rods 331, and a nob 342 shared between the three shift levers 331.

The bracket members 332 are fixed to the bottom surface of the stationary board member 311 at spacings, and the bracket members 333 are attached to the bottom surface of a board member 183 interconnecting the stationary board member 311 and a dag 184. The keys 110*a* and 110*b* are broken down into a high-pitched part, a middle-pitched part and a low-pitched part, and the bracket members 332 and 333 support the associated shift lever 331 below the three parts of the keyboard 110, respectively.

The arm members 334 are pivotally supported by the stationary board member 311 and by the board member 183, and cause the cam members 335 to move in the opposite direction to the shift levers 311.

The roller units 336 are fixed to the stationary board member 311 in the hollow space 316 and to the bottom surface of the movable board member 312 below the bedding screw 182, respectively, and the first cam members 335 in the hollow space 316 bidirectionally slide between the roller units 336. The reason why the roller units 336 are positioned below the beding screw 182 is that depressed keys 110*a* and 110*b* hardly deform the movable board member 312. The roller units 337 are fixed to the stationary board member 311 in the hollow space 317 and to the bottom surface of the movable board member 312, and the first cam members 335 in the hollow space 317 bidirectionally slide between the roller units 337. Each of the first cam members 335 has a sloop interconnecting a thin portion and a thick portion, and the first cam members 335 push up the movable board member 312 when the shift levers 331 slide from the front end to the rear end. As described hereinbefore, the pivotal joint 313/318 restricts a motion in the fore-and-aft direction, the movable board member 312 turns with respect to the pivotal joint 313/318.

While the key board instrument is in the acoustic sound mode, the shift levers 331 is pushed until the stoppers 340 is brought into contact with the bracket member 332 as shown in FIG. 1, and the movable board member 312 keeps the key frames 112 substantially horizontal as similar to anacoustic grand piano. The keyboard 110 and the action brackets 121 respectively remain in a standard position and in a closed position, and the hammer heads 145 can strike the associated strings 150.

On the other hand, if a player pulls the nob 342 until the stoppers 341 abut on the opposite surfaces of the bracket members 332 as shown in FIG. 2, the first cam members 335 allow the movable board member 312 to downwardly move, and declines at about 1 degree. The key action mechanisms 120 and the hammer assemblies 140 also decline, and, for this reason, hammer heads 145 can not reach the associated strings 150. The thick portion and the thin portion of each first cam member 335 is adjusted to appropriate thicknesses so that the movable board member 312 declines over 1 degree, and the jacks 129 escape from the hammer rollers when jacks 129 advance the associated hammer heads to the positions 10 millimeters from the strings 150. When the movable board 312 declines, the keyboard 110 and the action brackets 121 enter into an oblique position and a spaced position, respectively.

Thus, the small angular motion results in the large increment of the distance between the escaping point of jacks 129 and the strings 150 due to the wide distance between the keyboard 110 and the hammer assemblies 140, and the keyboard 110 looks stationary. Therefore, the angular motion of the keyboard 110 is advantageous over an up-and-down motion of the keyboard.

Figure 5A:
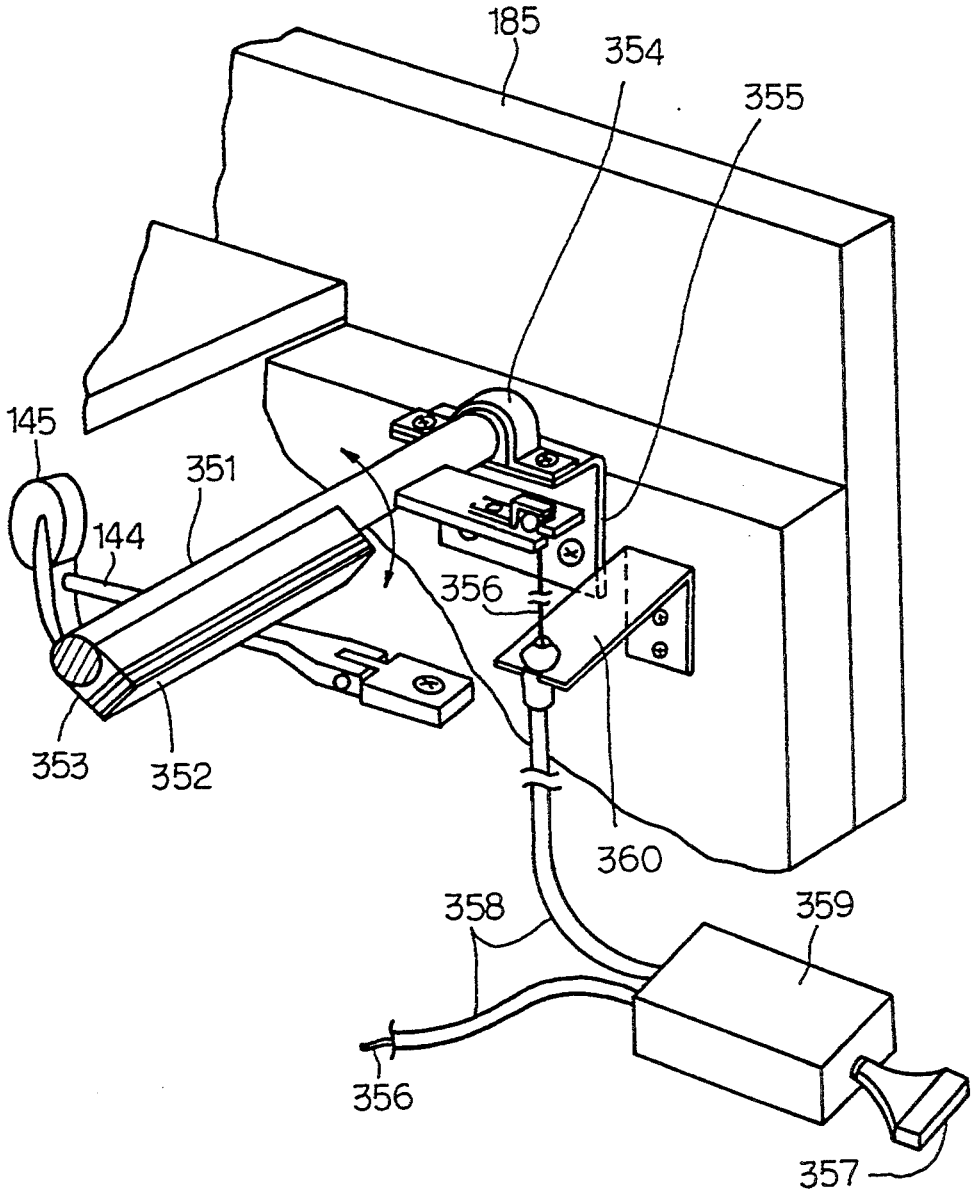
FIGS. 5A and 5B are perspective views showing a stopper mechanism incorporated in the keyboard instrument.
Figure 5B:
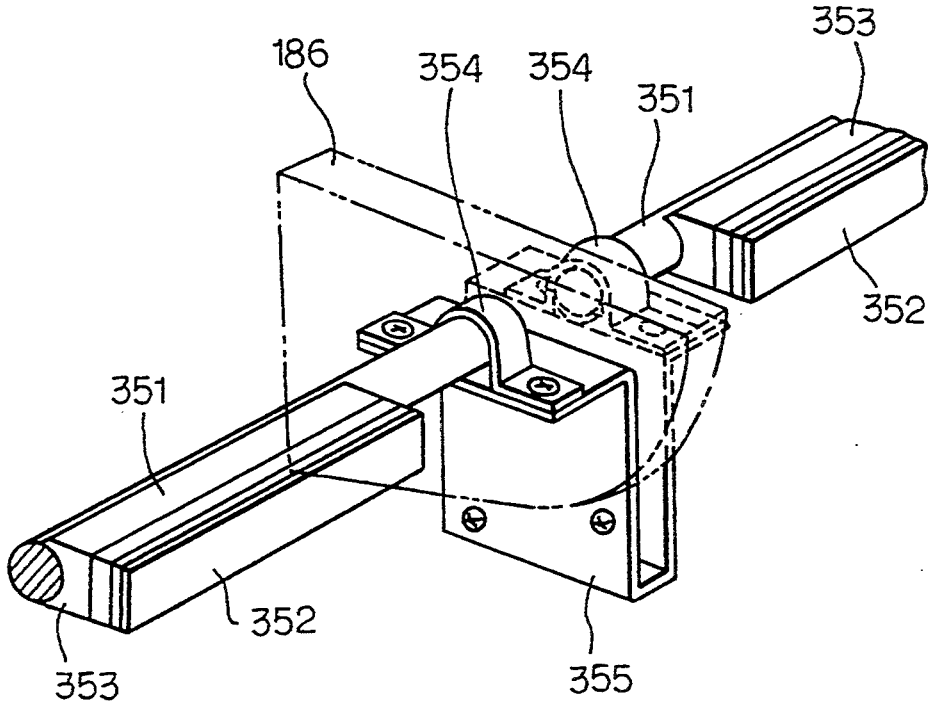

Turing to FIG. 5 of the drawings, the stopper mechanism 350 comprises a rod member 351 split into two portions and extending over the hammer shanks 144, laminated cushion members 352 supported through bracket members 353 by the rod member 351, journal units 354 supported by bracket members 355 by a wooden frame 185 and an arm plate 186, flexible wires 356 anchored to the rod member 351, a nob 357 connected with the flexible wires 356 and guide tubes 358 for the flexible wires 356. The nob 357 is fixed to the bottom surface of the stationary board member 311, and the guide tubes 358 extend between a stationary holder 359 and angle members 360.

If a player pushes and pulls the nob 357, the flexible wires 356 rotate the rod member 351, and the laminated cushion members 352 are changed between a free position (see FIG. 1) and a blocking position (see FIG. 2). Each of the laminated cushion members 352 is implemented by soft layers of, for example, felt or rubber and an outermost protection layer such as a leather sheet.

The nob may be linked with the nob 342, and an electric motor may drive the stopper mechanism 350 and the shift mechanism 330 under the control of the controller 210. A foot pedal or a solenoid-operated actuator is available instead of the flexible wires 356, the tube members 358 and the nob 357.

While the keyboard instrument is in the acoustic sound mode, the stopper mechanism 350 remains in the free position, and moves the laminated cushion members 352 out of the orbits of the hammer shanks 144. For this reason, when a player depresses a key **110*a* or 110*b*, the associated hammer head 145 strikes the strings 150 without interruption of the laminated cushion members 352**.

On the other hand, if the player changes the keyboard instrument to the silent mode, the stopper mechanism 350 enters into the blocking position, and the laminated cushion members 352 are opposed to the hammer shanks 144. The distance between the hammer shank 144 and the laminated cushion members 352 in the silent mode is approximately equal to the distance between the hammer head 145 and the associated strings 150 in the acoustic sound mode. In this instance, when the hammer head 145 is rotated over 47.5 millimeters in the acoustic sound mode, the hammer head 145 strikes the strings 150. Similarly, when the hammer head 145 is rotated over the same length in the silent mode, the hammer shank 144 is brought into contact with the laminated cushion member 352, and the hammer shank 144 rebounds on the laminated cushion member 352. As described hereinbefore, the angular motion of the movable board member 312 increases the distance between the spacing point and the strings 150 by several millimeters. Therefore, the hammer assemblies rebound on the laminated cushion members 352 without striking the strings 150 in the silent mode.

In this instance, the rod member 351 is positioned over the bottom surface of a pin block 187 (see FIG. 1), and a tuner can draw out the keyboard 110 without interruption of the stopper mechanism 350 for tuning.

Figure 6:
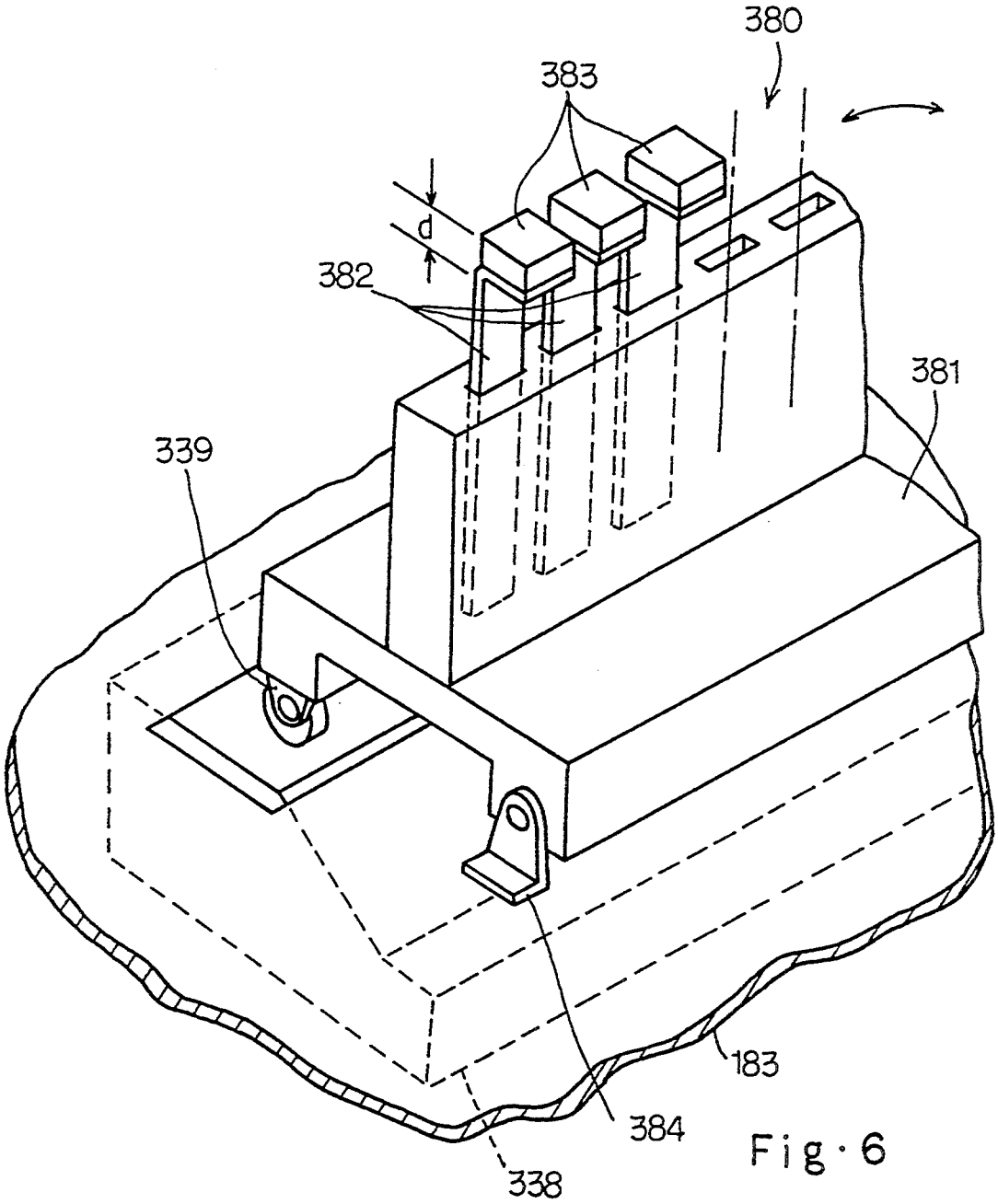
FIG. 6 is a perspective view showing a spacer mechanism incorporated in the keyboard instrument.

Turning to FIG. 6 of the drawings, the spacer mechanism 380 comprises a table member 381 having a vertical slits arranged at the same pitch as the keys **110*a* and 110*b*, a plurality of retainers 382 loosely inserted into the vertical slits and associated with the keys 110*a* and 110*b*, cushion members 383 of, for example, felt fixed to the leading ends of the retainers 382 and bracket members 384 pivotally supporting the table member 381. The roller units 339 are fixed to the table member 381, and are held in contact with the second cam member 338 as described hereinbefore. The retainers 382 are slidable in the slits, and the stroke of each retainer 382 is longer than the movement of the associated key 110*a* or 110*b*. The pitch of the slits is 13 millimeters in this instance. The table member 381 turns around the bracket members 384 depending upon the contact points between the roller units 339 and the second cam member 338, and the cushion members 383 are moved into and out of the orbits of the keys 110*a* and 110*b***.

In detail, the angular motion of the movable board member 312 changes the distance between the rear end portions of the keys **110*a*/110*b* and the damper levers 163, and each of the cushion members 383 makes up the variance of the distance. For this reason, the total thickness d of the retainer 382 and the cushion member 383 is equal to the variance of the distance between the associated key 110*a* or 110*b* and the associated damper lever 163**.

While the keyboard instrument is in the acoustic sound mode, the roller units 339 is on the thin portion of the second cam member 338, and the table member 381 declines. In this situation, the cushion members 383 remain out of the orbits of the keys 110*a*/110*b*, and the spacer mechanism 380 is in the idle position.

If, on the other hand, the keyboard instrument is in the silent mode, the second cam member 338 is moved toward the front end, and pushes up the roller units 339. As a result, the table member 381 turns in the clockwise direction in FIG. 1, and the cushion members 383 are placed between the rear end portions of the keys 110*a*/110*b* and the damper levers 163. Then, the spacer mechanism 380 enters into a make-up position. When a player depresses a key 110*a* or 110*b*, the rear end portion of the key 110*a* or 110*b* pushes up the bottom surface of the retainer 382, and the cushion member 383 pushes up the damper lever 163 so as to leave the damper head 166 from the strings 150.

Thus, even if the keyboard instrument enters into the silent mode, the keys 110*a* and 110*b* lift the associated damper mechanisms 160 through the spacer mechanism 380, and a player feels the same weight as the acoustic sound mode.

Description is hereinbelow made on performances in the acoustic sound mode and in the electronic sound sub-mode, and directions are determined on FIGS. 1 and 2. If a player wants to play the keyboard instrument in the acoustic sound mode, he or she pushes the nobs 342 and 357. As a result, the shift levers 331 cause the arm members 334 to pull the first cam members 335, and the first cam members 335 push up the movable board member 312. The movable board member 312 turns in the clockwise direction in FIG. 1, and the keyboard 110 enters into the standard position. The shift levers 331 move the second cam member 338 toward the rear end, and the spacer mechanism 380 enters into the make-up position. Moreover, the flexible wires 356 drive the rod member 351 for rotation, and the stopper mechanism 350 enters into the free position. Thus, the keyboard instrument embodying the present invention becomes ready for performance with the acoustic sounds as similar to an acoustic grand piano.

While the player is performing a music, he or she is assumed to depress a white key 110*a*, the capstan screw 113 rotates the whippen 126 and the jack 129 in the counter clockwise direction around the whippen flange 123, and jack 129 rotates the hammer assembly 140 in the clockwise direction around the shank flange 143.

The toe 131 is brought into contact with the regulating button 125, and the jack 129 per se starts rotation in the clockwise direction around the whippen 126. When the hammer head 145 reaches the point spaced from the strings 150 by 2 to 3 millimeters, the jack 129 escapes from the hammer roller 141, and the hammer head rushes toward the strings 150. The hammer head 145 strikes the strings 150, and the strings 150 vibrate for the acoustic sound. The hammer assembly 140 rebounds on the strings 150, and returns toward the home position. The back check 126 breaks the hammer assembly 140, and causes the hammer shank 144 to rest on the hammer shank stop felt 146. The laminated cushion members 352 and the cushion member 383 are out of the orbit of the hammer shank 144 and the orbit of the key 110*a*, and, for this reason, these members do not interfere the rotation of the hammer shank 144 and the rotation of the key 110*a*.

On the other hand, if the player wants to change the keyboard instrument to the electronic sound sub-mode, he or she pulls the nobs 342 and 357, and switches a main switch of the controller on. The mode shift switch 270 is adjusted to the electronic sound sub-mode, and the headphone 272 is inserted into the socket 272, by way of example. Even if the main switch is turned on in the acoustic sound mode, the controller 210 does not produce an analog audio signal in so far as the mode shift switch is not adjusted to the electronic sound sub-mode.

The shift levers 331 cause the arm members 334 to push the first cam members 335, and the first cam members 335 allow the movable board member 312 to turn in the counterclockwise direction due to the self-weight. The movable board member 312 becomes oblique, and the keyboard 110 enters into the oblique position. The shift levers 331 further move the second cam member 338 toward the front end, and the spacer mechanism 380 turns in the clockwise direction around the bracket members 384. The spacer mechanism 380 enters into the make-up position, and moves the cushion members 383 between the rear end portions of the keys 110*a* and 110*b* and the damper flanges 163. The flexible wires 356 drive the rod member 351 for rotation, and the laminated cushion members 352 become opposite to the hammer shanks 144. The stopper mechanism 350 enters into the blocking position.

The supervisor 211 acknowledges the mode signal MODE indicative of the electronic sound sub-mode, and powers the key sensors 240, the hammer sensors 250 and the pedal sensors 261 to 263. Thus, the keyboard instrument embodying the present invention becomes ready for performance with the synthesized sounds.

While the player is performing a music, he or she is assumed to depress a white key 110*a*, the key action mechanism 120 behaves as similar to the acoustic sound mode, and gives the unique key-touch to the player. However, the jack 129 escapes from the hammer roller 141 at the escaping point where the hammer head 145 is 10 millimeters spaced from the strings 150, and the hammer assembly 140 is driven for rotation in the clockwise direction toward the strings 150. The hammer head 145 travels over 47.5 millimeters as similar to the acoustic sound mode. However, the hammer shank 144 rebounds on the laminated cushion member 352 before the hammer head 145 strikes the strings 150.

On the other hand, the controller 210 behaves in the electronic sound sub-mode as follows. Upon entry into the electronic sound sub-mode, the supervisor 211 monitors the input port assigned to the detecting signals from the key sensors 240. When the key 110*a* starts to move from the rest position, the associated key sensor 240 supplies the detecting signal to the controller 210, and the supervisor 211 identifies the depressed key 110*a*. The supervisor 211 determines the hammer velocity in consideration of the detecting signal from the hammer sensor 250, and estimates the impact.

The supervisor 211 further checks the input port assigned to the detecting signals from the pedal sensors 261 to 263 to see whether or not the player steps on one of the pedals 170*d* to 170*f*. If the player does not step on the pedals 170*d* to 170*f*, the supervisor 211 accesses one of the groups of pcm data codes associated with the depressed key 110*a* in the data memory 212 or instructs the data processor 216 to tailor a group of pcm data codes for the depressed key 110*a*.

The supervisor 211 accesses the internal table thereof, and determines appropriate timing for producing the audio signal. The supervisor 211 waits for the appropriate timing, and supplies the group of pcm data codes to the audio signal generator 220 for producing the audio signal. The audio signal is amplified by the amplifier 222, and the headphone 206 produces a synthesized sound corresponding to the depressed key 110*a*.

However, if one of the pedals such as the damper pedal 170*e* is moved, the supervisor 207 notices it through the detecting signal from the pedal sensor 263, and the supervisor 211 accesses the pcm data codes for the depressed key 110*a* in the data memory 212 or instruct the data processor 216 to tailor the pcm data.

The supervisor 211 further accesses the pcm data codes in the data memory 214 or instructs the data processor 215 to tailor the pcm data codes so as to simulate the resonant vibrations on the related strings. The supervisor 211 controls the timing of the pcm data codes for the original vibrations and the timing of the pcm data codes for the resonant vibrations, and time delay is introduced between the timing for the original vibrations and the timing for the resonant vibrations. The audio signal generator 220 starts to produce the audio signal from the given pcm date codes at appropriate timing.

If the pedal 170*e* is upwardly moved to the rest position, the supervisor 211 instructs the data processor 216 to sequentially decrease the values of the pcm data codes at a selected speed so as to decay the synthesized tone as well as the resonant tones.

The supervisor 211 repeats the above described sequence for the depressed keys 110*a* and 110*b*, and produces the synthesized sounds through the headphone.

If a player wants to hear the synthesized sounds from the speaker system 271, the audio signals are supplied from the amplifier 222 to the speaker system 271, and the speaker system 271 produces the synthesized sounds.

Moreover, if the player changes the volume to zero in the silent mode, the player can practice the fingering on the keyboard 110 without sound.

As will be appreciated from the foregoing description, the keyboard instrument according to the present invention changes the gap between the hammer heads and the strings through the angular motion of the movable board member 312 without change the relative relation between the jacks 129, the regulating buttons 125 and the hammer assemblies, and, for this reason, the key action mechanisms 120 give the unique key-touch to the player in both acoustic sound and silent modes. The player can change the volume in the silent mode, and, for this reason, can perform a music at an arbitrary volume with the unique key-touch.

The angular motion of the movable board member 312 is desirable for the keyboard 110, because the keyboard looks unchanged.

Moreover, the keyboard 110, the key action mechanisms 120, the hammer assemblies 140, the strings 150, the damper mechanisms 160 and the pedal mechanism 170 are similar to acoustic grand piano, and, for this reason, replacement with the key bed structure 310 and addition of the electronic sound generating system 200, the shifting mechanism 330 and the spacing mechanism 380 remodels the acoustic grand pianos to the keyboard instrument according to the present invention.

Second Embodiment

Figure 7:
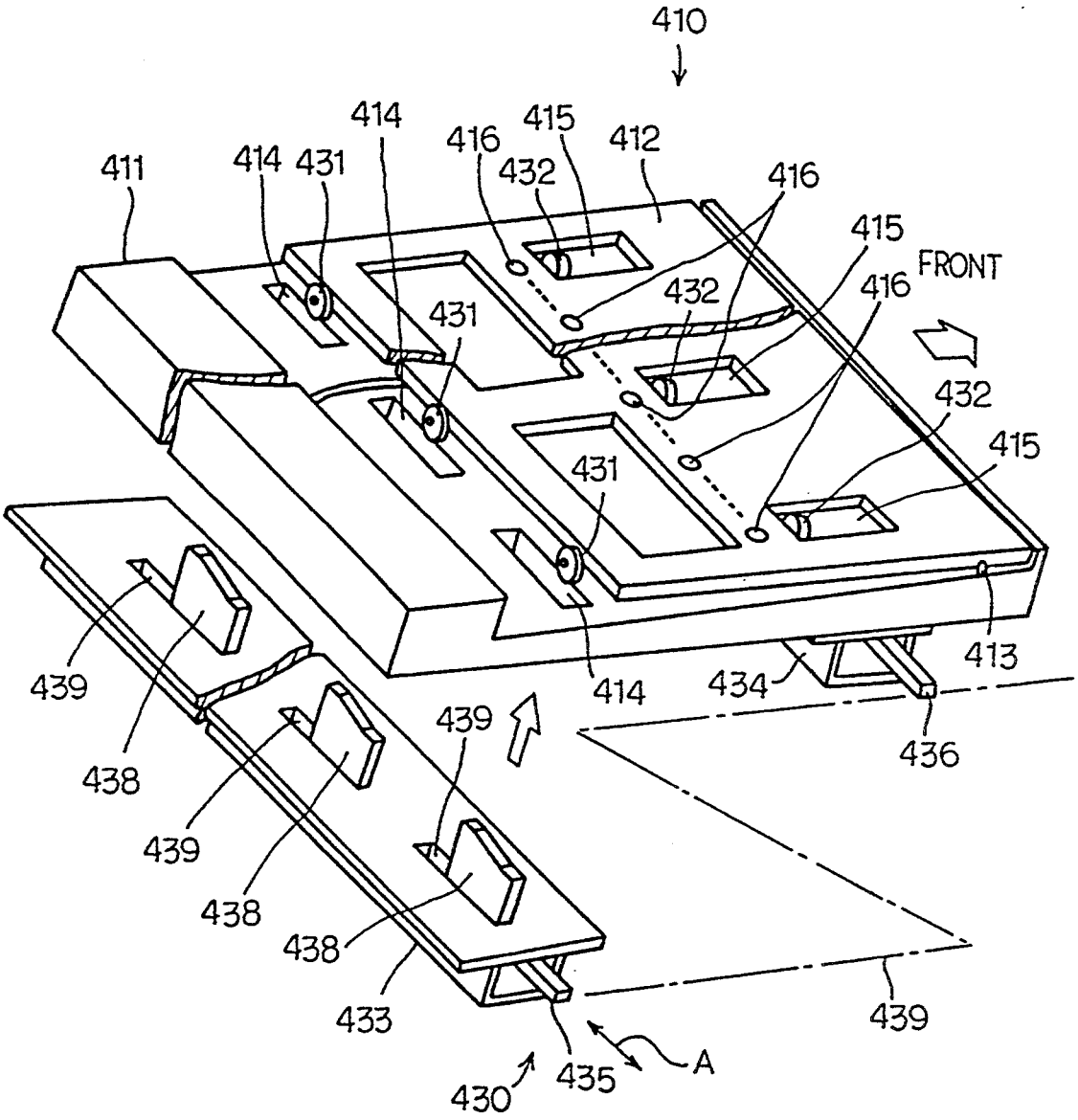
FIG. 7 is a perspectively view showing a key bed structure and an associated shifting mechanism in a partially disassembled state.
Figure 8:
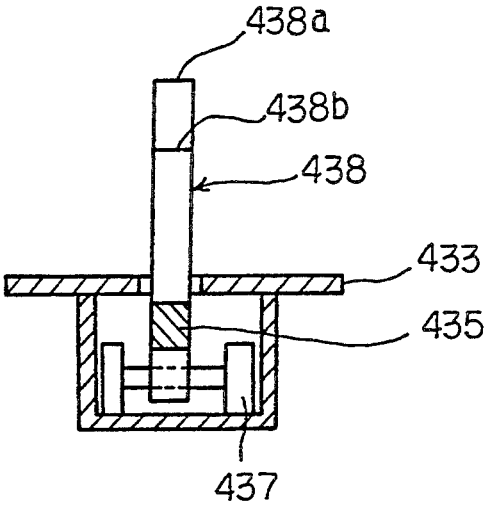
FIG. 8 is a cross sectional view showing the shifting mechanism shown in FIG. 7.

Turning to FIG. 7 of the drawings, a key bed structure 410 and s shifting mechanism 430 are incorporated in another keyboard instrument embodying the present invention, and the other components are similar to the first embodiment. For this reason, description is focused on the key bed structure 410 and the shifting mechanism 430 for the sake of simplicity.

The key bed structure 410 comprises a stationary board member 411 and a movable board member 412 turnable around a pivotal joint 413 fixed to the stationary board member 411. Though not shown in FIG. 7, the keyboard 110 and the action brackets 121 are supported by the movable board member 412.

Two rows of slits 414 are formed in the stationary board member 411. However, only one row of slits 414 is seen in FIG. 7. On the other hand, a row of rectangular small openings 415 are formed in the movable board member 412 in the vicinity of apertures 416 for the bedding screws.

The shifting mechanism 430 comprises two lines rollers 431 and 432 rotatably supported by the rear end portion and an intermediate portion of the movable board member 412, and the two lines of rollers 431 and 432 are inserted in the two rows of slits 414, respectively.

The shifting mechanism 430 further comprises two elongated boxes 433 and 434 attached to the bottom surface of the stationary board member 411, two rod members 435 and 436 loosely inserted in the hollow spaces of the elongated boxes 433 and 434, respectively, two sets of rollers 437 respectively attached to the rod members 435 and 436 for smoothly sliding in the elongated boxes 433 and 434 and two sets of cam members 438 upwardly projecting from the rod members 435 and 436, respectively. The two sets of cam members 438 respectively pass through two rows of slits 439 formed in the top boards of the elongated boxes 433 and 434, respectively. Each cam member 438 has a high portion 438*a*, a low portion 438*b* and a sloop contiguous to the high and low portions 438*a* and 438*b*, and the rollers 431 and 432 are held in rolling contact with the two rows of cam members 438.

The rod members 435 and 436 are bidirectionally moved in a direction indicated by arrow A. The rod members 435 and 436 are connected through an appropriate link member 439 with each other, and an appropriate link mechanism may change the direction of motions between the rod members 435 and 436 and a nob (not shown).

If the rod members 435 and 436 are drawn out from the elongated boxes 433 and 434, the rollers 431 and 432 are moved from the low portions 438*b* to the high portions 438*a*, and the movable board member 412 is angularly moved around the pivotal joint 413. As a result, the keyboard 110 and the action brackets 121 enter into the horizontal position, and a player can perform a music with acoustic sounds.

On the other hand, if the rod members 435 and 436 are pushed into the elongated boxes 433 and 434, the rollers 431 and 432 are moved to the low portions 438*b*, and the movable board member 412 becomes closer to the stationary board member 411. As a result, the keyboard 110 and the action brackets 121 are changed to the oblique portion and to the spaced position, and the player can perform a music with synthesized sounds.

The other components behave as similar to corresponding components of the first embodiment, and achieve the advantages of the first embodiment. Moreover, the shifting mechanism 430 is easily added to a grand piano for remodeling into the keyboard instrument according to the present invention.

Third Embodiment

Figure 9:
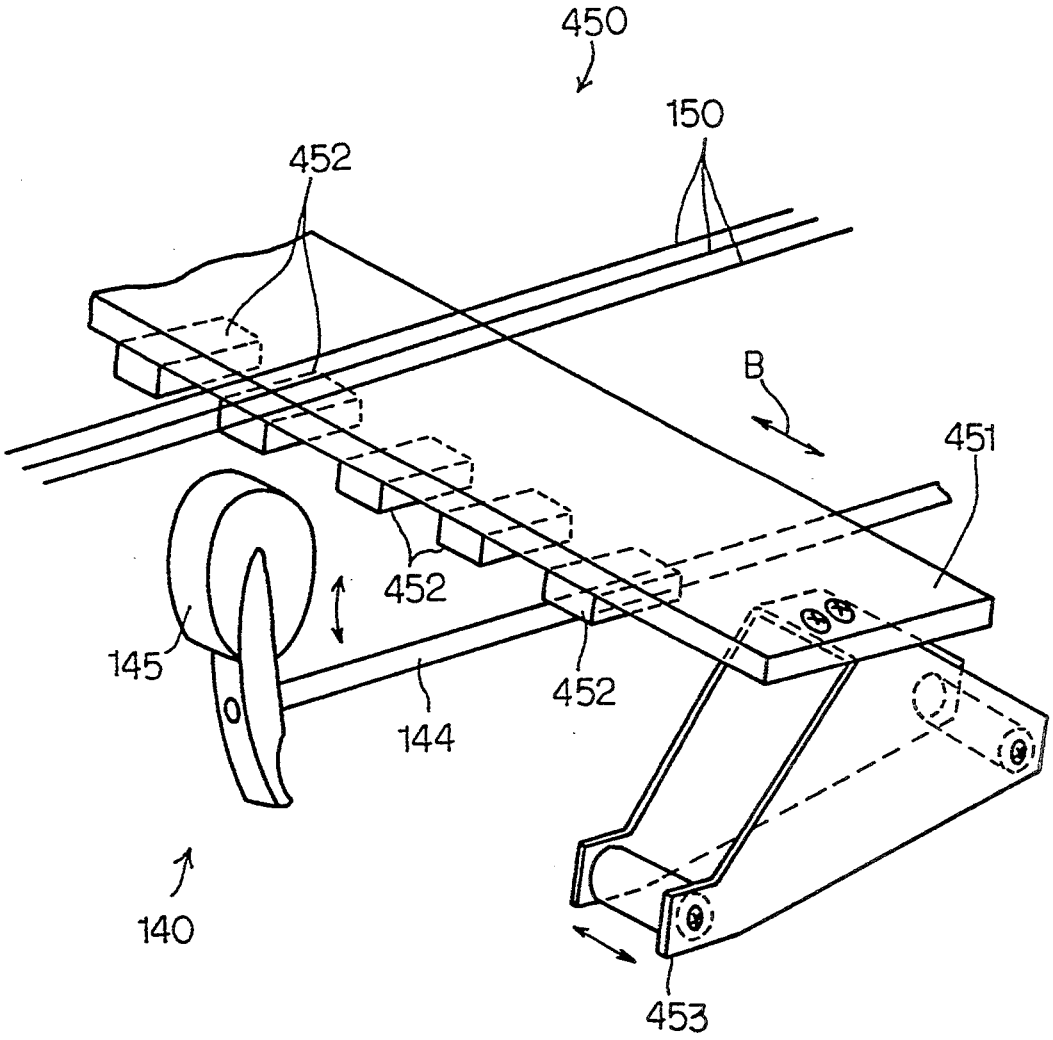
FIG. 9 is a perspective view showing a stopper mechanism incorporated in yet another keyboard instrument according to the present invention.

Turning to FIG. 9 of the drawings, a stopper mechanism 450 is incorporated in yet another keyboard instrument embodying the present invention. The other component members and units are similar to those of the first embodiment, and only the stopper mechanism 450 is described hereinbelow. The other components and units are labeled with the same references as those designating the corresponding components of the first embodiment.

The stopper mechanism 450 comprises a movable board member 451, a plurality of cushion members 452 attached to the movable board member 451 at intervals and a driving mechanism 453 for moving the movable board member 451 in direction of B. The pitch of the cushion members 452 is equal to the pitch of the hammer heads 145, and the driving mechanism 453 moves the movable board member 451 by a half pitch. In this instance, the pitch is about 13 millimeters.

While the hammer shanks 144 are opposed to the exposed movable board 451 between the cushion members 452, the stopper mechanism 450 is in the free position, and the hammer heads 145 can strike the associated sets of strings 452.

On the other hand, if the driving mechanism 453 moves the cushion members 452 to the blocking position where the hammer shanks 144 are opposed to the cushion members 452. In this situation, if a player depresses a key, the hammer assembly 140 is driven for rotation, and the hammer shank 144 is brought into abutting engagement with the cushion member 452, and the hammer assembly 140 rebounds on the cushion member 452 before the hammer head 145 strikes the strings 150.

The other components behaves as similar to those of the first embodiment, and the keyboard instrument implementing the third embodiment achieves all the advantages of the first embodiment.

Figure 10:
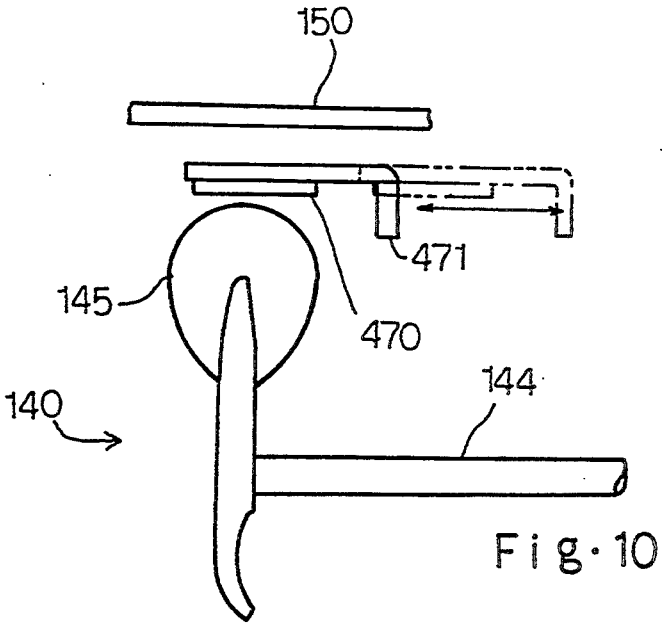
FIG. 10 is a side view showing a modification of the stopper mechanism.

The stopper mechanism may be implemented by cushion members 470 attached to a bracket 471 at intervals, and bracket 471 moves the cushion members 470 into and out of a gap between the strings 150 and the hammer heads 145 as shown in FIG. 10.

Fourth Embodiment

Figure 11:
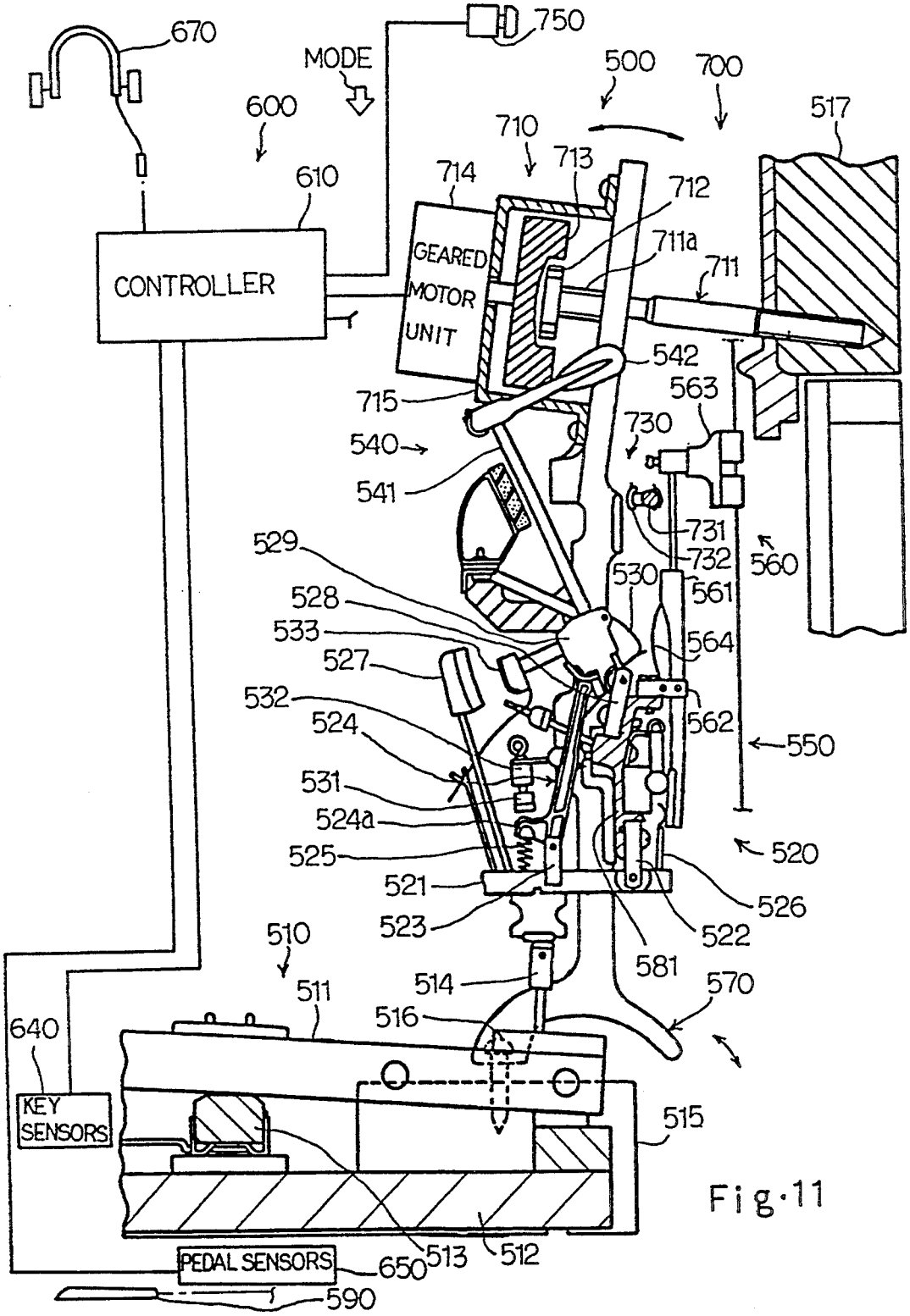
FIG. 11 is a partially cut-away side view showing an essential feature of still another keyboard instrument according to the present invention.

Turning to FIG. 11 of the drawings, still another keyboard instrument embodying the present invention largely comprises an upright piano 500, an electronic sound generating system 600 and a mode controlling system 700, and selectively enters into the acoustic sound mode and the silent mode.

The upright piano 500 comprises a keyboard 510 having eighty-eight keys 511, a plurality of key action mechanisms 520 linked with the keys 511, a plurality of hammer assemblies 540 respectively driven by the key action mechanisms 520 for rotation, a plurality sets of strings 550 vertically stretched over a sound board (not shown), a plurality of damper mechanisms 560 driven by the keys 511 and a plurality of action brackets 570.

The keyboard 510 is supported by a key bed 512, and each of the keys 511 is swingable with respect to a balance rail 513 on the key bed 512. A capstan screw 514 upwardly projects from the rear end portion of each key 511, and pushes up the associated key action mechanism 520 for rotation.

An action block 515 is stationary with respect to the key bed 512, and one of the action brackets 570 is turnably supported by the action block 515 by means of an action base screw 516.

The plurality of key action mechanisms 520 are similar in arrangement, and each key action mechanism 520 comprises a whippen/whippen heel assembly 521 held in contact with the capstan screw 514, a whippen flange 522 bolted to a center rail 581 and swingably supporting the whippen/whippen heel assembly 521, a jack flange 523 fixed to a left side portion of the whippen/whippen heel assembly 521, a jack 524 rotatably supported by the jack flange 523, a jack spring 525 urging the jack 524 in the clockwise direction, a damper spoon 526 projecting from a right side portion of the whippen/whippen heel assembly 521, and a back check 527 projecting from the whippen/whippen heel assembly 2*a* on the left side of the jack flange 523.

The key action mechanism 520 further comprises a butt flange 528 fixed to the center rail 581, a butt 529 rotatably supported by the butt flange 528, a butt spring 530 urging the butt 529 in the counter clockwise direction, and a regulating button 531 downwardly projecting from a regulating rail 532 in opposing relation to a toe 524*a* of the jack 524. The regulating rail 532 is supported by the center rail 581. The head portion of the jack 524 is in contact with the butt skin attached to the lower surface of the butt 529, and the toe 524*a* of the jack 524 is spaced apart from the regulating button 531. The regulating button 531 has a leather sheet where the toe 524*a* is brought into contact.

The key action mechanism 520 further comprises a catcher 533 projecting from the right side surface of the butt 529, and the catcher 533 is opposed to the back check 527. While the key 511 is staying in the rest position, the catcher 533 is spaced apart from the back check 527. However, after the hammer assembly 540 rebounds on the strings 550, the butt 529 rotates in the counter clockwise direction, and the catcher 533 is brought into contact with the back check 527 for breaking the rotation of the butt 529.

The plurality of hammer assemblies 540 are also similar in arrangement to one another, and each hammer assembly 540 comprises a hammer shank 541 implanted into the butt 529 and a hammer head 542 supported by the hammer shank 541 in opposing relation to the associated strings 550.

The damper mechanisms 560 are similar in arrangement to one another, and each of the damper mechanisms 560 comprises a damper lever 561, a damper lever flange 562 fixed to the center rail 581 for turnably supporting the damper lever 561, a damper head 563 for damping the vibrations on the associated set of strings 550, and a damper spring 564 urging the damper lever 561 such that the damper head 563 and the lower end portion of the damper lever 561 are brought into contact with the associated strings 550 and with the damper spoon 526, respectively. While the associated key 511 is staying in the rest position, the damper head 563 is held in contact with the strings 550. However, the damper head 563 is left from the strings 550 before an impact of the hammer head 542 against the strings 550.

As described hereinbefore, the jack flange 522, the whippen flange 528, the regulating rail 581 and the damper lever flange 562 are supported by the center rail 581, and the center rail 581 is in turn supported by the action brackets 570. For this reason, the center rail 581 and, accordingly, the key action mechanisms/hammer assembly/damper mechanism 520, 540 and 560 are turnable around the action base screws 516 with respect to the action blocks 515.

The key action mechanism and the hammer assembly 540 thus arranged behaves in both acoustic sound and silent modes as follows. When a player depresses the key 511, the key 511 is driven for rotation in the counter clockwise direction, and the capstan screw 514 pushes up the whippen/whippen heel assembly 521. The whippen/whippen heel assembly 521 is rotated around the whippen flange 522 in the clockwise direction, and the jack 524 is also rotated without changing the relative relation to the whippen/whippen heel assembly 521. As a result, the jack 524 pushes up the butt 529, and rotates the butt 529 in the clockwise direction around the butt flange 528. The toe 524 becomes closer to the regulating button 531, and is finally brought into contact therewith. While the whippen/whippen heel assembly 521 is being rotated in the clockwise direction, the damper spoon 526 is urging the damper lever, and leaves the damper head 563 from the associated strings 550. Thus, the key 511 is rotated against the key action mechanism 520 and the damper mechanism 560, and the player feels the resistance in both acoustic sound and silent modes.

The key 511 is continuously rotated toward the end position, and the capstan screw 514 continues to push up the whippen/whippen heel assembly 521. The rotation of the whippen/whippen heel assembly 521 causes the jack 524 to turn around the jack flange 522 against the jack spring 525, and the jack 524 escapes from the butt 529. This results in a rotation of the butt 529 in the clockwise direction, and gives a unique key-touch to the player. As will be described hereinlater, the relative relation between the whippen/whippen assembly 521, the jack 524, the regulating button 532 and the butt 529 is unchanged between the acoustic sound mode and the silent mode, the player feels the key-touch unique at all times.

Although the hammer head 542 strikes and rebounds on the associated set of strings 550 in the acoustic sound mode, the hammer head 542 does not reach the strings. 550 in the silent mode.

The electronic sound generating system 600 comprises a controller 610, a plurality of key sensors 640 respectively monitoring the keys 511, pedal sensors 650 respectively associated with damper, soft and muffler pedals 590, and a headphone 670. Each of the key sensors 640 is implemented by a shutter plate with four different slit patterns and a photo-coupler, and estimates the impact of the hammer head 542 against the strings 550 and the timing for producing synthesized tone. The pedal sensors 650 monitors the associated pedals 590, and cause the controller 610 to impart the effects to the synthesized tones as if the damper, soft and/or a muffler pedals 590 are manipulated in the acoustic sound mode. The headphone 670 is insertable into a socket provided on, for example, a key block (not shown), and the player can confirm the tones corresponding to the depressed keys 51 I through the headphone in the electronic sound sub-mode.

The mode controlling system 700 comprises a gap regulating mechanism 710 for driving the action brackets 570, a stopper mechanism 730 for changing between a free position and a blocking position and a mode shift switch 750 for producing a mode signal MODE indicative of either acoustic sound or silent mode, and the gap regulating mechanism 710 and the stopper mechanism 730 are under the supervision of the controller 610.

The gap regulating mechanism 710 comprises an action bolt 711 screwed into a stationary frame 517, a nut 712 engaged with a male screw **711*a* of the action bolt 711 loosely passing the action bracket 570, a chuck member 713 for grasping the nut 712, and a geared motor unit 714 supported through a bracket member 715 by one of the action brackets 570. Another set of gap regulating mechanism 710 may be provided for another action bracket 570, and the geared motor unit 714** may be of a supersonic motor silently rotatable.

Figure 12:
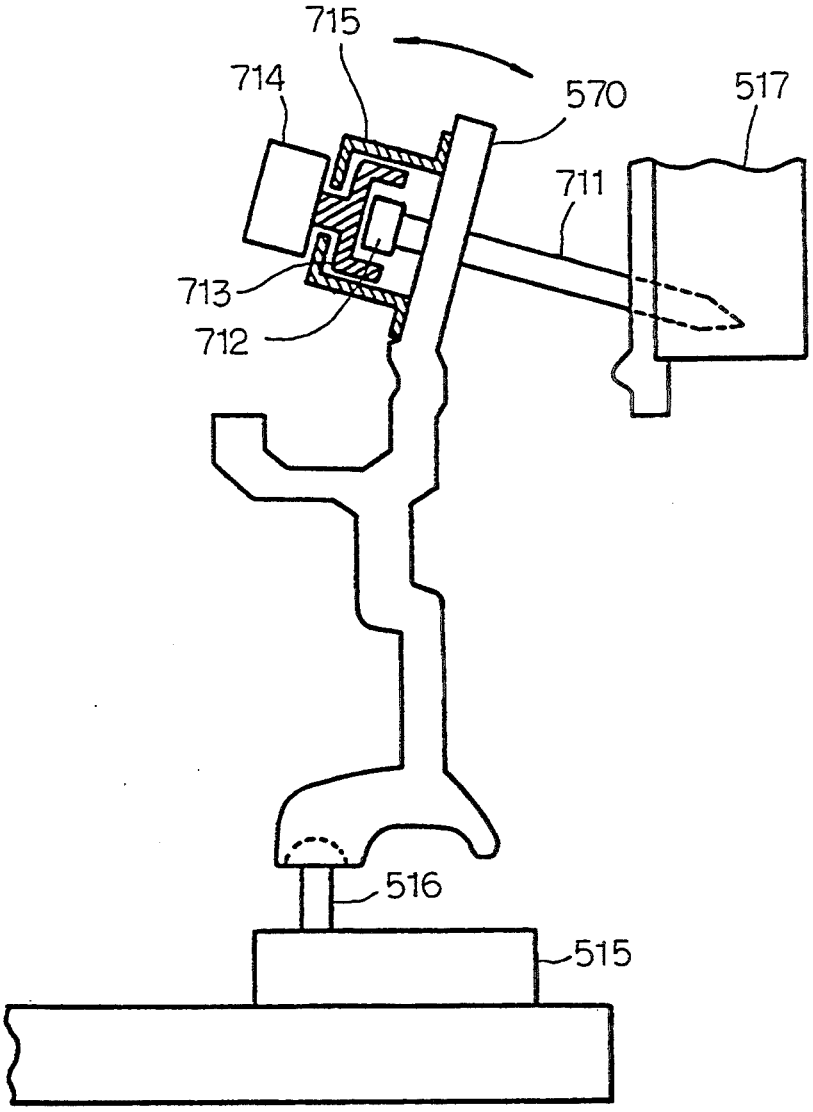
FIG. 12 is a partially cut-away side view showing the arrangement of a gap controlling mechanism incorporated in the still another keyboard instrument.

When the keyboard instrument embodying the present invention enters into the acoustic sound mode, the geared motor unit 714 screws the nut 712 into the male screw **711*a*, and the action bracket 570 urges the center rail 581 against the damper spring 564. The center rail 581 and, accordingly, all of the action brackets 570 become closer to the stationary frame 517 and to the strings 550 through a rotation in the clockwise direction around the action base screws 516 as will be better seen from FIG. 12, and the gap between the hammer heads 542 and the strings 550** are adjusted to the standard value of an upright piano.

On the other hand, when the keyboard instrument is shifted to the silent mode, the controller 610 actuates the geared motor unit 714, and the geared motor unit 714 rotates the nut 712 in such a manner as to be spaced from the action bracket 570. Then, the damper spring 564 urges the center rail 581 in the direction to space apart from the strings 550, and the action brackets 570 turn around the action base screws 516 in the counter clockwise direction. As a result, the gap between the hammer heads 542 and the strings 550 is increased by 2 to 3 millimeters. In this situation, if the keys are depressed, the hammer shanks 541 rebound on the stopper mechanism 730 before the hammer heads 542 strike the associated strings 550.

The stopper mechanism comprises 731 a rotational rod member 731 rotationally supported by stationary board members of the upright piano, cushion members 732 attached to the rotational rod member 731 and a motor unit 733 controlled by the controller 610. The stopper mechanism 730 is maintained in the free position in the acoustic sound mode, and is changed from the free position to the blocking position when the keyboard instrument is shifted to the silent mode.

Namely, the motor unit 733 rotates the rod member 731, and causes the cushion member 732 to be opposite to the hammer shanks 541 in the blocking position. In this situation, although the hammer head 542 travels over the same distance as in the acoustic sound mode, the hammer shank 541 is brought into contact with the cushion member 732 before an impact of the hammer head 542, and rebounds on the cushion member 732. In other words, the hammer head 542 does not strike the strings 550, and, accordingly, the strings 550 never vibrate for producing an acoustic sound. On the other hand, if the stopper mechanism 730 remains in the free position, the hammer head 542 strikes the strings 550 before the hammer shank 541 is brought into contact with the cushion member 732.

Figure 13:
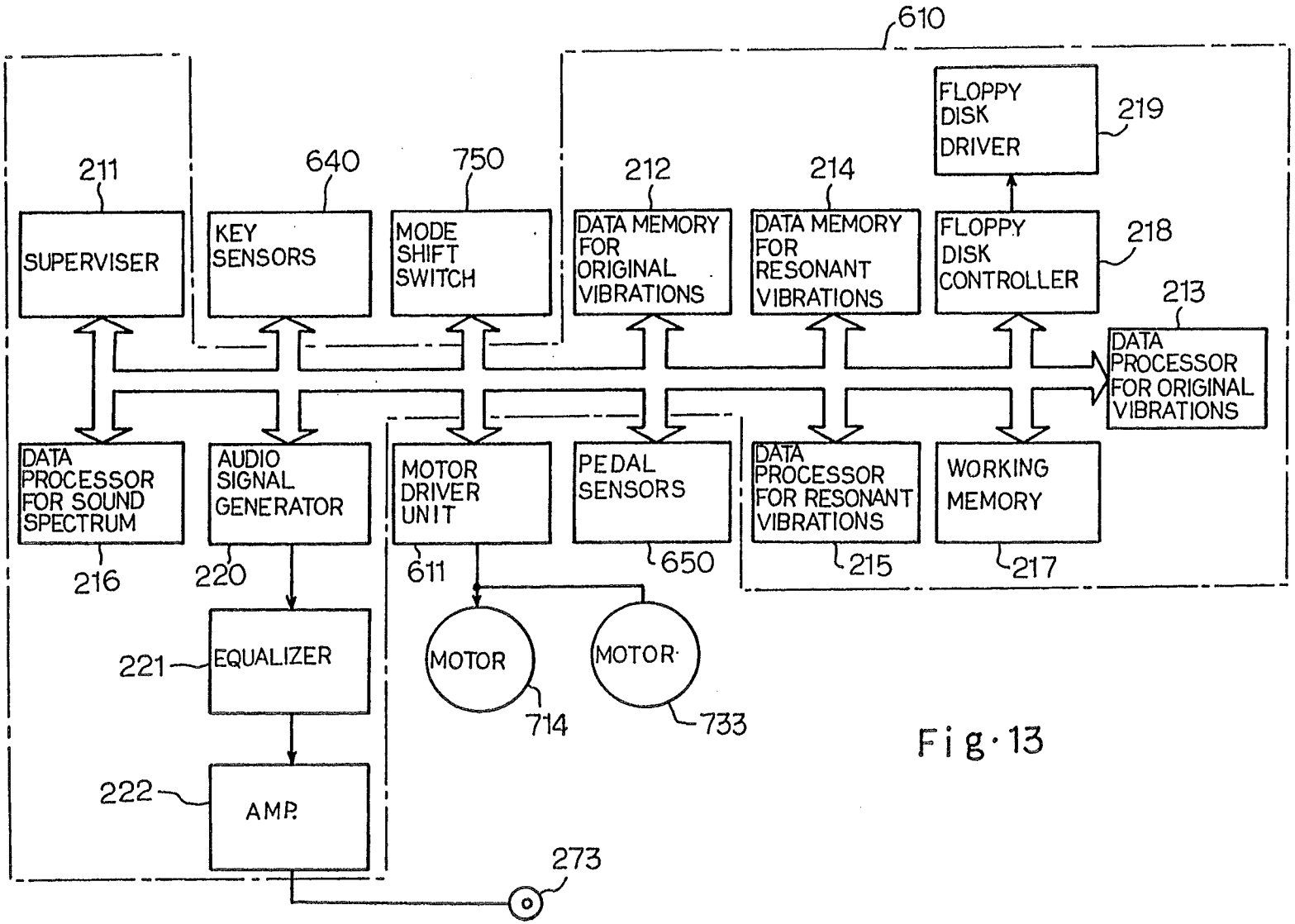
FIG. 13 is a block diagram showing the arrangement of a controller incorporated in the still another keyboard instrument.

Turning to FIG. 13 of the drawings, the arrangement of the controller 610 is illustrated. The controller 610 is similar in arrangement to the controller 210 except for a motor driver unit 611 connected with the geared motor unit 714 and with the motor unit 733. For this reason, the components of the controller 610 are labeled with the same references designating the corresponding components of the controller 210 without detailed description.

Figure 14:
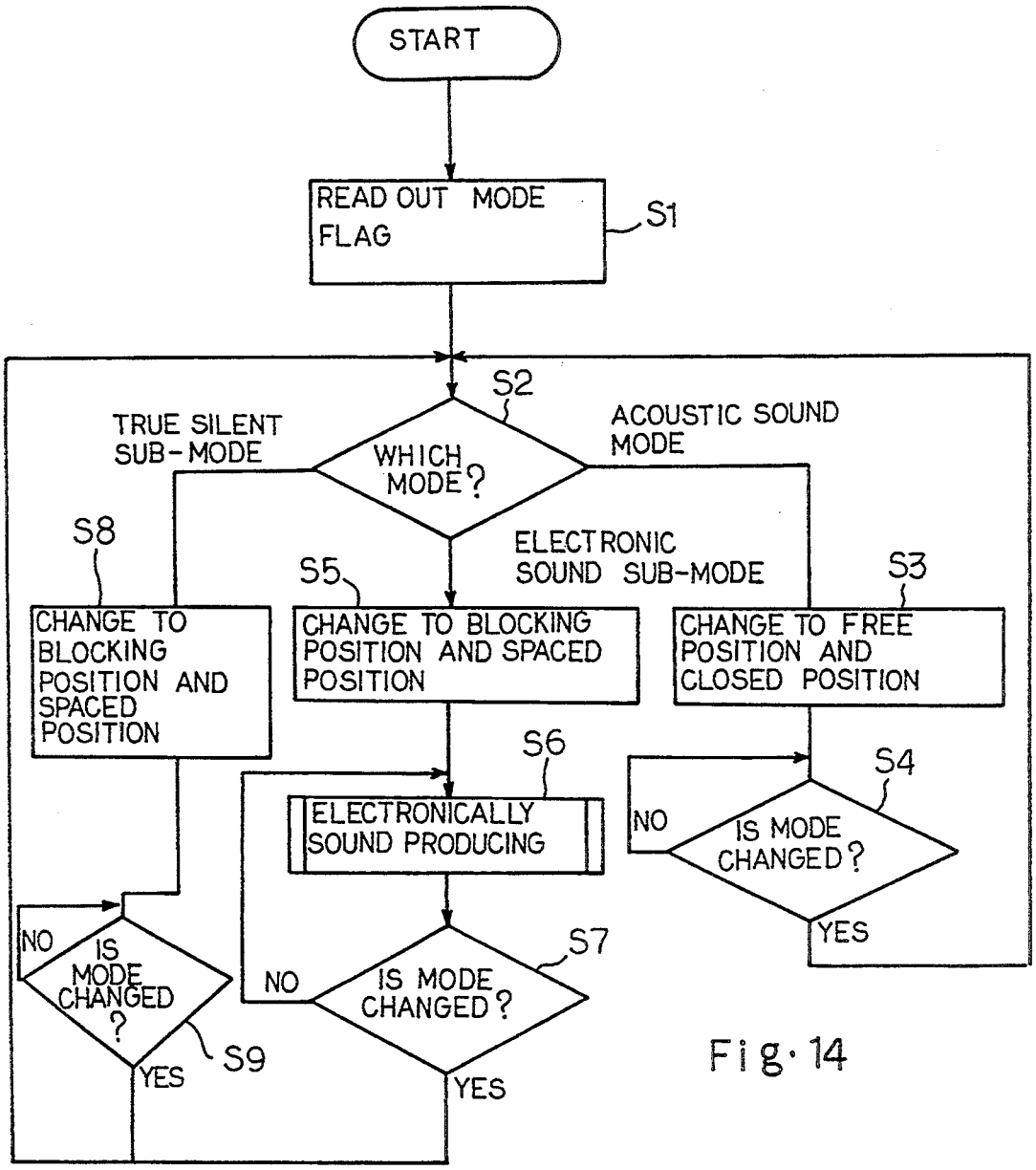
FIG. 14 is a flow chart showing a program sequence executed by the controller.

The controller 610 executes a program sequence shown in FIG. 14 for controlling the gap regulating mechanism 710 and the stopper mechanism 730. While being powered, the supervisor 211 periodically checks the input signal port assigned to the mode signal MODE to see whether to keep a mode flag indicative of the operation mode or to change the mode flag.

The supervisor 211 periodically reads out the mode flag from the internal register as by step S1, and checks the mode flag to see whether the player instructs the acoustic sound mode, the electronic sound sub-mode or the true silent sub-mode as by step S2.

If the player designates the keyboard instrument to enter into the acoustic sound mode, the supervisor 211 instructs the motor driver unit 611 to change the stopper mechanism 730 and the gap regulating mechanism 710 to the free position and the closed position, respectively, as by step S3. Then, the geared motor unit 714 screws the nut 712 into the male screw 711*a*, and the motor unit 733 causes the cushion member 732 to be opposite to the hammer shanks 541.

While the player is performing a music in the acoustic sound mode, the supervisor 211 periodically checks the input port assigned to the mode signal MODE to see whether or not the player changes the mode from the acoustic sound producing mode to the electronic sound sub-mode or the true silent sub-mode as by step S4. If the answer to the step S4 is given negative, the supervisor 211 repeats step S4, and the player continues to perform the music with the acoustic sounds.

However, if the player manipulates the mode shift switch 750, the answer to the step S4 is given positive, and the supervisor 207 returns to step S2. If the answer to the step S2 is indicative of the electronic sound sub-mode, the supervisor 211 rewrites the mode flag, and instructs the motor driver unit 611 to change the stopper mechanism 730 and the gap regulating mechanism 710 to the blocking position and the spaced position as by step S5. Then, the cushion member 732 is directed to the hammer shanks 541, and the gap between the hammer heads 542 and the strings 550 is decreased by 2 to 3 millimeters.

While the player is selectively depressing the keys 511, the controller 610 electronically synthesizes sounds through an electronically sound producing sub-routine S6 in cooperation with the key sensors 640, the pedal sensors 650 and the headphone 670. The supervisor 211 periodically checks the input signal port assigned the mode signal MODE as by step S7, and reiterates the loop consisting of steps S6 and S7 while the answer to step S7 is given negative. However, if the player changes the mode shift switch 750, the supervisor 211 returns to step S2.

If the mode flag is indicative of the true silent sub-mode, the supervisor 211 proceeds to step S8, and instructs the motor driver unit 611 to keep the gap regulating mechanism 710 and the stopper mechanism 710 in the spaced position and in the blocking position. The supervisor 211 checks the input signal port assigned the mode signal MODE as by step S9, and returns to step S2 with the positive answer.

Figure 15:
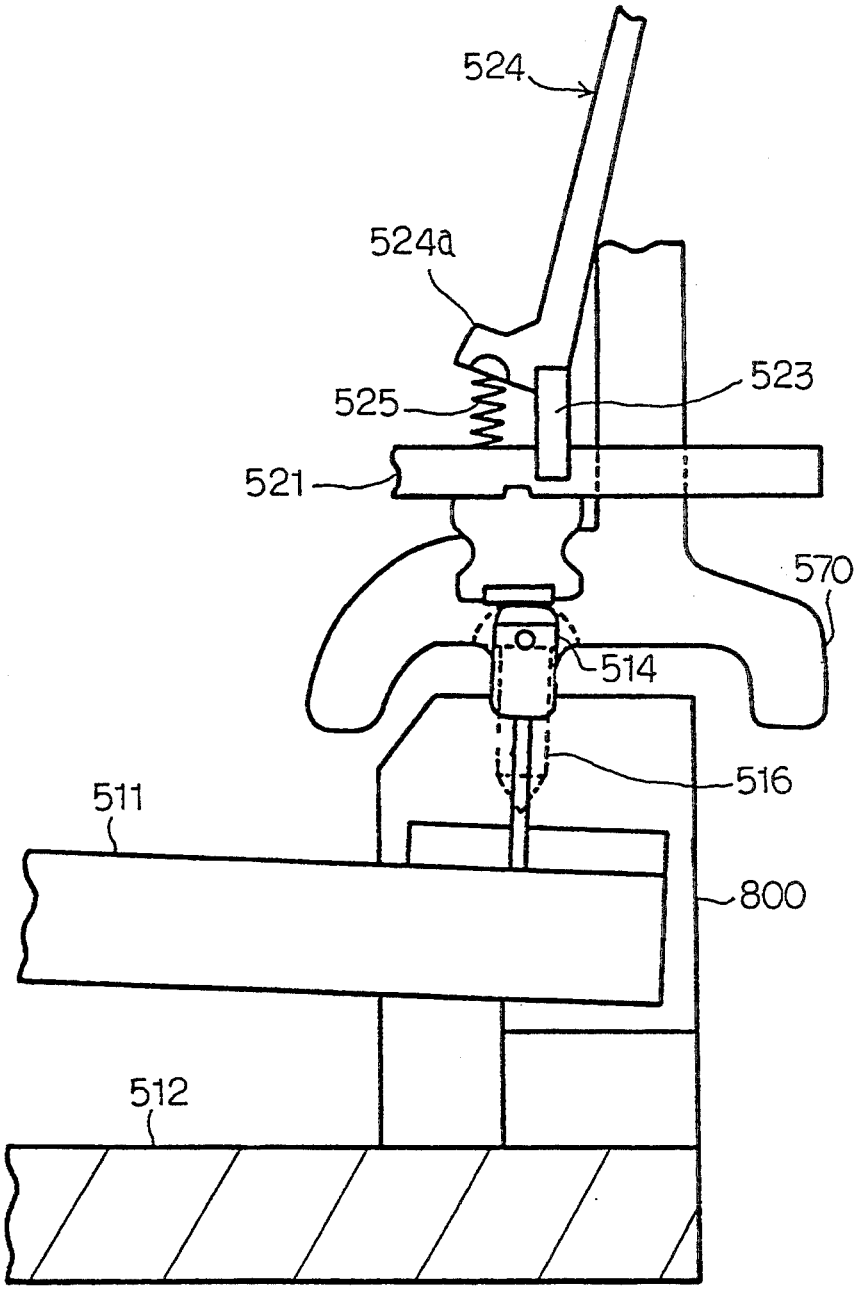
FIG. 15 is a side view showing an essential part of a modification of the keyboard instrument according to the present invention.
Figure 16:
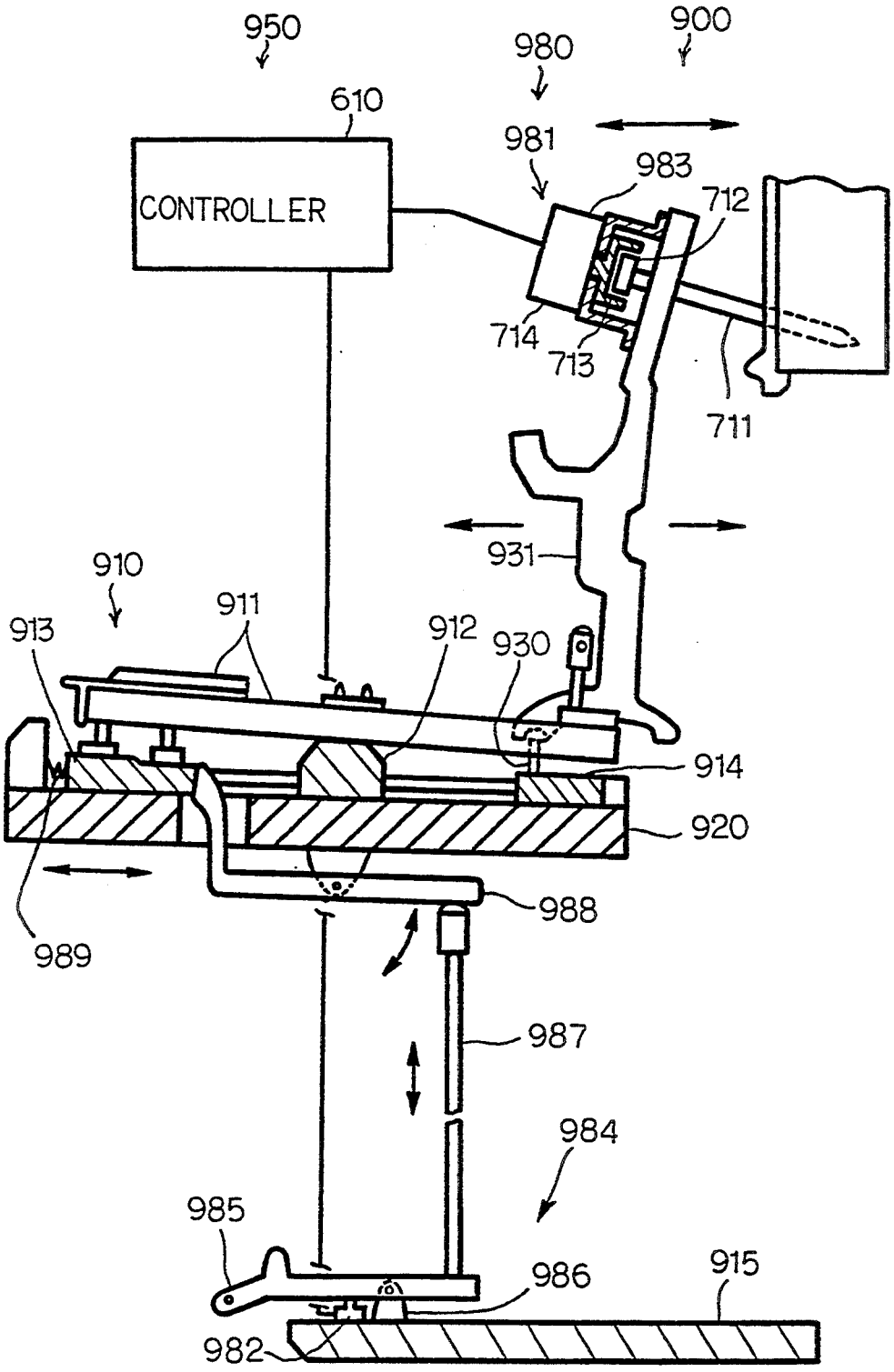
FIG. 16 is a partially cut-away side view showing a keyboard instrument according to the present invention.

If the fulcrums of the action brackets 570 are aligned with the contact point between the capstan button 514 and the whippen/whippen heel 521 by replacing the action block 515 with a higher action block 800 as shown in FIG. 15, the angular motion of the action brackets 570 does not affect the reactive relation between the capstan button 514 and the key action mechanism 520, and the unique key-touch is conserved regardless of the mode of operation. Fifth Embodiment Turning to FIG. 16 of the drawings, a keyboard instrument embodying the present invention largely comprises an upright piano 900, an electronic sound generating system 950 and a mode controlling system 980 as similar to the fourth embodiment, and selectively enters into the acoustic sound mode and the silent mode.

The upright piano 900 comprises a keyboard 910 slidable on a key bed 920, and the keyboard 910 has a plurality of keys 911, a balance rail 912 for allowing the keys 911 to swing thereon and front and rear rails 913 and 914 connected with the balance rail 912. Key action mechanisms, hammer assemblies, sets of strings and damper mechanisms are further incorporated in the upright piano 900. However, detailed description is omitted, because these components are similar to those of the fourth embodiment.

The upright piano 900 further comprises action base screws 930 and action brackets 931 turnably supported by the action base screws 930, respectively.

The electronic sound generating system 950 is similar to the electronic sound generating system 600, and the components of the system 950 are labeled with the same references as those of the electronic sound generating system 600.

The mode controlling system 980 comprises a gap regulating mechanism 981, a stopper mechanism (not shown) and a switching unit 982 provided on a bottom plate 915, and the gap regulating mechanism 981 has a first pushing sub-mechanism 982 for the action brackets 931 and a second pushing sub-mechanism 983 for the keyboard 910. The first pushing sub-mechanism 982 is similar to the gap regulating mechanism 710, and no further description is incorporated hereinbefore for avoiding repetition.

Figure 17:
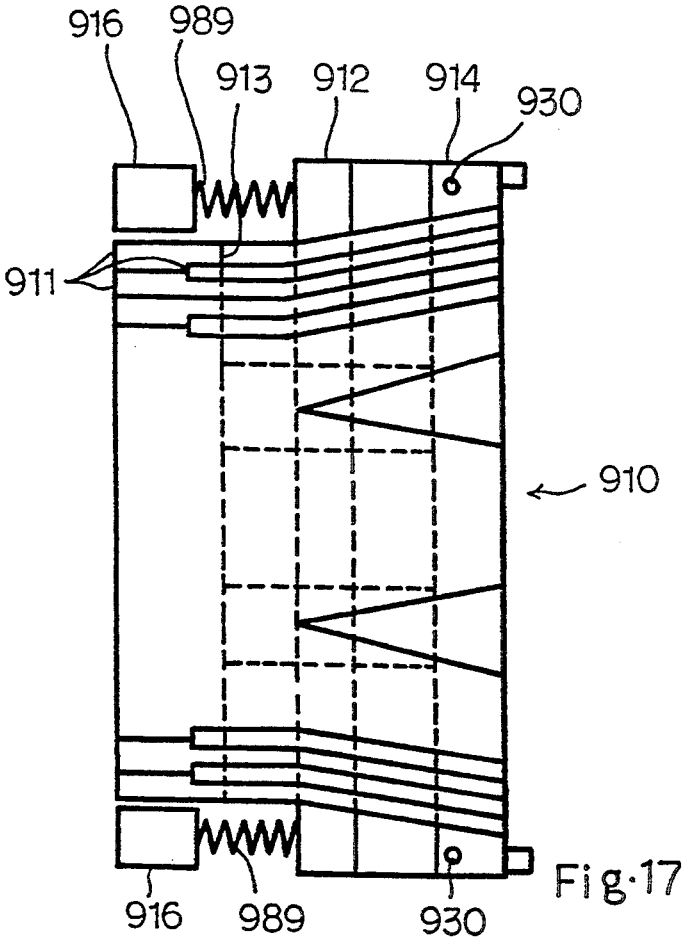
FIG. 17 is a plan view showing a keyboard incorporated in the keyboard instrument shown in FIG. 16.
Figure 18:
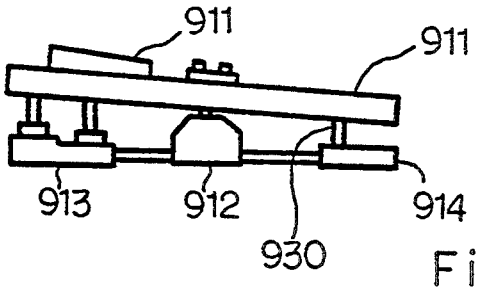
FIG. 18 is a side view showing the keyboard shown in FIG. 17.

The second pushing mechanism 983 comprises a pedal member 985 swingable around a bracket member 986 on the bottom plate 915, a connecting rod 987 linked with the rear end portion of the pedal 985 and a pair of springs 989 inserted between key blocks 916 and the center rail 912 as will be better seen from FIGS. 17 and 18. The switching unit 982 is manipulated by the pedal 985, and the pedal 985 is maintained in depressed state by means of a retainer (not shown).

When a player likes to perform a music with synthesized tones, he or she steps on the pedal 985, and the controller 610 instructs the motor driver unit to rotate the geared motor unit 714 in a suitable direction. The geared motor unit 714 loosens the nut 712, and the damper lever spring (not shown) urges the center rail (not shown) and the action brackets 931 such that the hammer heads (not shown) are spaced from the strings (not shown) as similar to the fourth embodiment.

The pedal 985 further pushes up the connecting rod 987, and the lever 988 is driven for rotation in the counter clockwise direction. The lever 988 thus rotated pushes the front rail 913 against the springs 989, and the keyboard 910 slides on the key bed 920 toward the player. As a result, the gap regulating mechanism 980 increases the gap between the hammer heads (not shown) and the strings (not shown) through the straight motion of the key bed. The controller 610 changes the stopper mechanism to the blocking position.

In this situation, if the player depresses a key 911, the associated key action mechanism rotates the hammer assembly toward the strings. However, the hammer shank is brought into contact with the cushion member of the stopper mechanism before strike against the stings, and the strings do not vibrate for producing an acoustic sound. On the other hand, the electronic sound generating system 950 synthesizes an electronic sound with the note corresponding to that assigned to the depressed key, and the player can confirm the note through a headphone.

The gap regulating mechanism 981 does not change the relative relation between the keyboard 910, the key action mechanisms, the hammer assemblies and the damper mechanisms, and the keyboard instrument implementing the fifth embodiment gives the unique key-touch to the player in both acoustic sound and silent modes.

Figure 19:
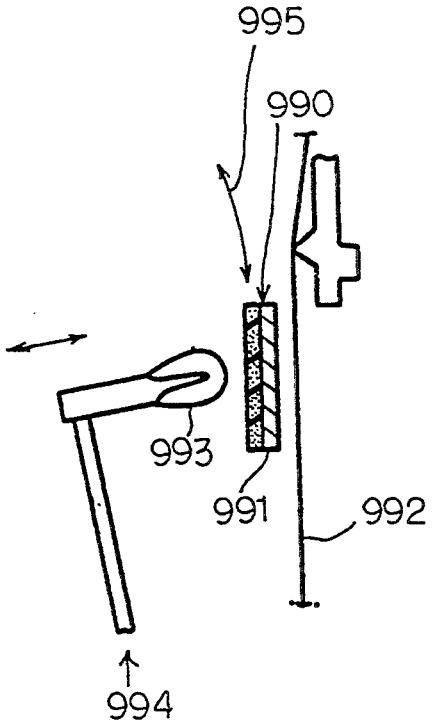
FIG. 19 is a side view showing an essential part of a modification of the keyboard instrument shown in FIG. 16.

In the above described embodiments, the stopper mechanisms are engageable with the hammer shanks. However, a stopper mechanism 990 may interpose a muffler 991 between strings 992 and hammer heads 993 as shown in FIG. 19. In detail, the muffler 991 is shared between hammer assemblies 994, and is movable between a free position in the acoustic sound mode and a blocking position in the silent mode through an angular motion indicated by an arrow 995. Although the acoustic piano has a keyboard, key action mechanisms, damper mechanisms, they are not illustrated in FIG. 19. Moreover, the keyboard instrument shown in FIG. 19 further has an electronic sound generating system and a gap regulating mechanism.

If a gap regulating mechanism is not incorporated in the keyboard, the hammer heads 993 is brought into contact with the muffler 991 before the jacks (not shown) escape from the hammer assemblies 994. However, the gap regulating mechanism increases the gap between the hammer heads 993 and the strings, and the hammer heads 993 are brought into contact with the muffler 991 after the escape, thereby giving the unique piano-touch to the player.

As will be appreciated from the foregoing description, the keyboard instrument according to the present invention changes the gap between the hammer assemblies and the strings depending upon the mode of operation, and the player feels the key touch unchanged between the acoustic sound mode and the silent mode.

Although particular embodiments of the present invention have been shown and described, it will be obvious to those skilled in the art that various changes and modifications may be made without departing from the spirit and scope of the present invention. For example, a keyboard instrument according to the present invention may produce synthesized sounds through a headphone only, and may be switched between the electronic sound sub-mode and the true silent mode by inserting and pulling out the headphone. Moreover, the spacer mechanism 380 may be deleted from another keyboard instrument according to the present invention, because the key action mechanisms 120 can give a quasi-piano key-touch to a player in the silent mode. Yet another keyboard instrument according to the present invention may estimate the impact on the basis of the detecting signal from either key or hammer sensor only. This means that the hammer sensors or the key sensors are deleted from the keyboard instrument. The key, hammer and pedal sensors may detect the motion of the objects through magnetoelectric phenomenon.

What is claimed is:

1. A keyboard instrument selectively entering into an acoustic sound mode for producing acoustic sounds and an electronic sound mode for producing synthesized sounds, comprising:

a) an acoustic piano having a-1) a keyboard implemented by a plurality of swingable keys depressed by a player in both acoustic sound and electronic sound modes, notes of a scale being assigned to said plurality of swingable keys , a-2) a plurality of key action mechanisms respectively linked with said plurality of swingable keys, and selectively actuated by depressed keys of said keyboard in both acoustic sound and electronic sound modes, a-3) a plurality of hammer assemblies respectively associated with said plurality of key action mechanisms, and selectively driven for rotation by actuated key action mechanisms linked with said depressed keys in both acoustic sound and electronic sound modes, said actuated key action mechanisms and the associated hammer assemblies producing a piano-touch in both acoustic sound and electronic sound modes, a-4) a plurality of string means respectively associated with said plurality of hammer assemblies, and selectively struck by hammer assemblies driven by said actuated key action mechanisms in said acoustic sound mode for producing acoustic sounds, and a-5) an action bracket means supporting said plurality of key action mechanisms and said plurality of hammer mechanisms, and movable without change of a relative location between said plurality of key action mechanisms and said plurality of hammer mechanisms;

b) an electronic sound generating system enabled in said electronic sound mode for producing synthesized sounds having notes identified by said depressed keys; and c) a mode controlling system operative to move said action bracket means for changing between a closed position and a spaced position, a gap between said plurality of hammer assemblies and said plurality of string means allowing said plurality of hammer assemblies to strike said plurality of string means in said closed position, said gap being increased in said spaced position for preventing said plurality of string means from strikes of said hammer assemblies.

2. The keyboard instrument as set forth in claim 1, in which said acoustic piano is a grand piano, and said mode controlling system comprises c-1) a key bed structure having a stationary board member, a movable board member supporting said keyboard and said action bracket means and angularly movable with respect to said stationary board member, and a pivotal joint means located below front end portions of said plurality of swingable keys and pivotally connecting a front portion of said movable board member with said stationary board member; and c-2) a shifting means provided in association with said key bed structure, and manipulated by said player for angularly moving said movable board member, said gap between said plurality of hammer assemblies and said plurality of string means being increased when said movable board member is moved to a closer position to said stationary board member.

3. The keyboard instrument as set forth in claim 2, in which said mode controlling system further comprises a stopper mechanism having a first cushion means movable between a free position and a blocking position, said plurality of hammer assemblies being brought into contact with said first cushion means in said blocking position before said strikes of said hammer assemblies, said first cushion means in said free position allowing said plurality of hammer assemblies to strike said plurality of string means.

4. The keyboard instrument as set forth in claim 2 or 3, in which said acoustic piano further comprises a-6) a plurality of damper mechanisms respectively associated with said plurality of string means, and moved by said plurality of swingable keys between a contact position and a spaced position, said plurality of damper mechanisms in said contact position being held in contact with said plurality of string means, damper mechanisms moved to said depressed keys being spaced from said associated string means, said mode controlling system further comprising a spacer mechanism having a plurality of second cushion means movable between an idle position and a makeup position, said plurality of second cushion means in said idle position being out of orbits of said plurality of swingable keys for allowing said depressed keys to be directly brought into contact with said associated damper mechanisms, said plurality of second cushion means in said make-up position being moved into a gap between said plurality of swingable keys and said plurality of damper mechanisms so that said depressed keys are brought into contact with said associated damper mechanisms through the associated second cushion means.

5. The keyboard instrument as set forth in claim 4, in which said shifting mechanism is linked with said movable board member and said spacer mechanism so that said movable board member and said spacer mechanism simultaneously enters into said closer position and said make-up position.

6. The keyboard instrument as set forth in claim 1, in which said acoustic piano is an upright piano, and in which said action bracket means is turnable with respect to a stationary key bed for mounting said keyboard, and supports said plurality of key action mechanisms and said plurality of hammer assemblies, said mode controlling system comprising c-1) a gap regulating mechanism connected with said action bracket means, and moving said action bracket means through an angular motion of said action bracket means for changing said action bracket means between a closed position in said acoustic sound mode and a spaced position in said electronic sound mode with respect to said plurality of string means, a gap between said plurality of hammer assemblies and said plurality of string means being increased in said spaced position rather than said closed position, and c-2) a stopper mechanism provided between said plurality of hammer assemblies and said plurality of string means, and shifted between a free position and a blocking position, said stopper mechanism in said blocking position being brought into contact with the hammer assemblies associated with said depressed keys before the associated string means are struck, said stopper mechanism in said free position allowing said hammer assemblies associated with said depressed keys to strike said string means without contact therewith.

7. The keyboard instrument as set forth in claim 6, in which said acoustic piano further comprises a-6) a plurality of damper mechanisms turnably supported by a center rail fixed to said key action bracket means, and moved by said plurality of swingable keys between a contact position and a spaced position, said plurality of damper mechanisms in said contact position being held in contact with said plurality of string means by means of damper lever spring means, said damper mechanisms moved by said depressed keys being spaced from said associated string means against said damper lever spring means, said damper spring means urging said action bracket means toward said spaced position at all times.

8. The keyboard instrument as set forth in claim 1, in which said acoustic piano is an upright piano, and in which said action bracket means and said keyboard are slidable on a stationary key bed, and said action bracket means supports said plurality of key action mechanisms and said plurality of hammer assemblies, said mode controlling system comprising c-1) a gap regulating mechanism connected with said action bracket means and said keyboard, and causing said action bracket means and said keyboard to slide on said stationary key bed for changing said action bracket means between a closed position in said acoustic sound mode and a spaced position in said electronic sound mode with respect to said plurality of string means, a gap between said plurality of hammer assemblies and said plurality of string means being increased in said spaced position rather than said closed position, and c-2) a stopper mechanism provided between said plurality of hammer assemblies and said plurality of string means, and shifted between a free position and a blocking position, said stopper mechanism in said blocking position being brought into contact with the hammer assemblies associated with said depressed keys before the associated string means are struck, said stopper mechanism in said free position allowing said hammer assemblies associated with said depressed keys to strike said string means without contact therewith.

9. The keyboard instrument as set forth in claim 1, in which said mode controlling system comprises c-1) a gap regulating mechanism operative to move said action bracket means for changing a gap between said plurality of hammer assemblies and said plurality of string means, said gap being increased in said electronic sound mode rather than said acoustic sound mode, and c-2) a stopper mechanism movable between a blocking position in said electronic sound mode and a free position in said acoustic sound mode, said stopper mechanism having a cushion member opposite to hammer heads of said plurality of hammer assemblies in said blocking position and positioned out of orbits of said plurality of hammer assemblies in said free position.

* * * * *